US011311751B2

(12) United States Patent
Dobashi

(10) Patent No.: US 11,311,751 B2
(45) Date of Patent: Apr. 26, 2022

(54) HYDRAULIC DEVICE

(71) Applicant: Ogura & Co., Ltd., Ebina (JP)

(72) Inventor: Keita Dobashi, Kanagawa (JP)

(73) Assignee: Ogura & Co., Ltd., Ebina (JP)

( * ) Notice: Subject to any disclaimer, the term of this patent is extended or adjusted under 35 U.S.C. 154(b) by 343 days.

(21) Appl. No.: 16/654,278

(22) Filed: Oct. 16, 2019

(65) Prior Publication Data

US 2021/0031059 A1 Feb. 4, 2021

(30) Foreign Application Priority Data

Jul. 30, 2019 (JP) ..... JP2019-139614

(51) Int. Cl.

| | |
|---|---|
| ***A62B 3/00*** | (2006.01) |
| ***B25F 5/00*** | (2006.01) |
| ***B25F 5/02*** | (2006.01) |
| ***F15B 21/00*** | (2006.01) |

(52) U.S. Cl.

CPC ..... *A62B 3/005* (2013.01); *B25F 5/005* (2013.01); *B25F 5/02* (2013.01); *F15B 21/001* (2013.01)

(58) Field of Classification Search

CPC .... B25F 3/00; B25F 5/005; B25F 5/02; B25F 5/026; F15B 21/001; A62B 3/005

See application file for complete search history.

(56) References Cited

U.S. PATENT DOCUMENTS

| | | | | |
|---|---|---|---|---|
| 5,272,811 | A * | 12/1993 | Armand | A62B 3/005 30/228 |
| 8,505,877 | B2 * | 8/2013 | Strohmeier | A62B 3/005 254/104 |
| 8,943,699 | B2 * | 2/2015 | Strohmeier | B23D 27/02 30/228 |
| 9,832,936 | B2 * | 12/2017 | Ishiguro | A01G 3/037 |
| 10,933,478 | B2 * | 3/2021 | Brown | B23D 29/00 |
| 2005/0223886 | A1 * | 10/2005 | Oide | B23D 29/00 91/428 |
| 2018/0195532 | A1 * | 7/2018 | Kimura | F16D 41/069 |

FOREIGN PATENT DOCUMENTS

JP 2010-280011 A 12/2010

* cited by examiner

*Primary Examiner* — Andrew M Tecco
*Assistant Examiner* — Nicholas E Igbokwe
(74) *Attorney, Agent, or Firm* — Renner, Kenner, Greive, Bobak, Taylor & Weber

(57) ABSTRACT

A hydraulic device 10 includes a hydraulic pump 20, a tool 70, an oil passage 30, 32, 50, 52 for sending the pressure oil generated by the hydraulic pump 20 to the tool 70 and returning return oil from the tool 70 to the hydraulic pump 20, a handle 90 configured to be held by one hand of a worker, a switching part 88 disposed at the oil passage 30, 32, 50, 52 and configured to switch a path for at least one of the pressure oil and the return oil, and an operation part 80 for operating the switching part 88. The operation part 80 is disposed at a position that allows the operation part 80 to be operated with the hand of the worker holding the handle 90, or with a finger of the hand holding the handle 90.

18 Claims, 23 Drawing Sheets

HYDRAULIC DEVICE

CROSS-REFERENCE TO RELATED APPLICATION

This application claims priority to Japanese Patent Application No. 2019-139614 filed on Jul. 30, 2019, the entire contents of which are incorporated herein by reference.

TECHNICAL FIELD

The present invention relates to a hydraulic device which is hydraulically operated.

BACKGROUND ART

Hitherto, a portable hydraulic device has been used for rescue purposes, and one example thereof is disclosed, for example, in Japanese Laid-Open Patent Publication No. 2010-280011 (JP2010-280011A), etc. The hydraulic device disclosed in Japanese Laid-Open Patent Publication No. 2010-280011 includes a hydraulic pressure generating unit having a battery, an electric motor supplied with power from the battery and a hydraulic pump driven by the electric motor, and a head unit which is attachable to and detachable from the hydraulic pressure generating unit and which has a tip tool driven by pressure oil generated by the hydraulic pressure generating unit. As the tip tool to be provided to the head unit, various kinds of tools such as a cutter and a spreader are prepared, and a wide variety of work can be handled by exchanging the head unit. In addition, by making the hydraulic pressure generating unit and the head unit separable from each other, the portability can be improved, and the burden on a worker at a site can be reduced.

Here, the conventional hydraulic device is configured such that, when pressure oil generated by the hydraulic pump is sent to the tip tool or return oil is returned from the tip tool to the hydraulic pump, a path for the pressure oil and a path for the return oil in an oil passage are switched by a spool valve. In addition, an operation part is provided to the hydraulic device, and, when a worker turns the operation part, the spool valve acts to advance and retract, and the flow direction of the pressure oil or the like is controlled by the spool valve moving up and down relative to a piston rod.

In the conventional hydraulic device, the distance between a handle and the operation part for operating the spool valve is large. Thus, when the worker desires to change the direction of movement of the tip tool when performing work with the tip tool by holding a grip portion close to the electric motor with one hand (for example, the right hand) and grasping the handle with the other hand (for example, the left hand), the worker has to release the right hand from the grip portion and operate the operation part with the right hand in a state where the worker is grasping the handle with the left hand. Thus, there is a problem that the workability deteriorates.

The present invention has been made in consideration of such circumstances, and an object of the present invention is to provide a hydraulic device that allows an operation part to be operated with a hand of a worker holding a handle, or with a finger of the hand holding a handle, without releasing any hand from the handle or a grip portion, so that workability can be improved.

A hydraulic device of the present invention includes: a hydraulic pump configured to generate pressure oil; a tool configured to operate by the pressure oil generated by the hydraulic pump; an oil passage for sending the pressure oil generated by the hydraulic pump to the tool and returning return oil from the tool to the hydraulic pump; a handle configured to be held by one hand of a worker; a switching part disposed at the oil passage and configured to switch a path for at least one of the pressure oil and the return oil; and an operation part for operating the switching part, and the operation part is disposed at a position that allows the operation part to be operated with the hand of the worker holding the handle, or with a finger of the hand holding the handle.

In the hydraulic device of the present invention, a distance between the handle and the operation part in a longitudinal direction of the hydraulic device may fall within a range of 0 mm to 50 mm.

In this case, the distance between the handle and the operation part in the longitudinal direction of the hydraulic device may fall within a range of 5 mm to 50 mm.

Furthermore, the distance between the handle and the operation part in the longitudinal direction of the hydraulic device may fall within a range of 9 mm to 45 mm.

In the hydraulic device of the present invention, the handle may have a bar-like portion extending in a direction orthogonal to a longitudinal direction of the hydraulic device, and the worker may be allowed to operate the operation part with the hand grasping the bar-like portion of the handle, or with the finger of the hand grasping the bar-like portion of the handle.

In this case, a distance from a main body of the hydraulic device to the bar-like portion of the handle may be larger than a distance from the main body of the hydraulic device to the operation part.

In the hydraulic device of the present invention, the operation part may have a shaft part, a lever which is attached to the shaft part and which is configured to rotate about an axis of the shaft part, and an operation portion which is disposed at the lever and which is configured to be operated with the hand of the worker holding the handle, or with the finger of the hand holding the handle, and the path in the oil passage may be switched at the switching part by rotation of the shaft part of the operation part.

In this case, the operation portion may be formed by cutting a portion from a substantially spherical body.

Furthermore, a line which passes through a center of a flat surface, of the operation portion, obtained by cutting the portion from the substantially spherical body and which is orthogonal to the flat surface may be tilted relative to a longitudinal direction of the hydraulic device.

Furthermore, the handle may have a bar-like portion extending in a direction orthogonal to the longitudinal direction of the hydraulic device, and the worker is allowed to operate the operation part with the hand grasping the bar-like portion of the handle, or with the finger of the hand grasping the bar-like portion of the handle, and the line which passes through the center of the flat surface, of the operation portion, obtained by cutting the portion from the substantially spherical body and which is orthogonal to the flat surface may extend toward the bar-like portion of the handle.

Also, a recess may be formed on the operation portion at a location where the portion is cut from the substantially spherical body, and the recess has a shape curved such that the recess is a part of a spherical surface of a virtual sphere.

Furthermore, a line connecting a center of the recess to a center of the virtual sphere may be tilted relative to a longitudinal direction of the hydraulic device.

Also, the handle may have a bar-like portion extending in a direction orthogonal to the longitudinal direction of the hydraulic device, and the worker is allowed to operate the operation part with the hand grasping the bar-like portion of the handle, or with the finger of the hand grasping the bar-like portion of the handle, and a line connecting a center of the recess to a center of the virtual sphere may extend toward the bar-like portion of the handle.

Also, the lever may be movable between an advance position and a retraction position, when the lever is located at the advance position, the path in the oil passage may be switched at the switching part such that the tool moves in a first direction, and when the lever is located at the retraction position, the path in the oil passage may be switched at the switching part such that the tool moves in a second direction.

In this case, the lever may also be movable to a neutral position, and when the lever is located at the neutral position, the path in the oil passage may be closed at the switching part, whereby the tool does not operate.

Furthermore, wherein the lever may extend from the shaft part toward the handle when the lever is located at the neutral position.

Also, the advance position and the retraction position of the lever may be located at opposite sides with the neutral position interposed therebetween.

The hydraulic device of the present invention may further include a drive part configured to drive the hydraulic pump, and the operation part may be configured to be able to switch ON/OFF of the drive part.

In the hydraulic device of the present invention, the operation part may be moveable in a direction toward a main body and in a direction away from the main body, and when the operation part is moved in the direction toward the main body or in the direction away from the main body, the path in the oil passage may be switched at the switching part. In this case, the operation part may have a lever and an operation portion which is disposed at the lever and which is configured to be operated with the hand of the worker holding the handle, or with the finger of the hand holding the handle, the operation portion may be formed by cutting a portion from a substantially spherical body, and when the lever or the operation portion of the operation part is moved in the direction toward the main body or in the direction away from the main body, the path in the oil passage may be switched at the switching part.

DESCRIPTION OF THE PREFERRED EMBODIMENTS

Figure 1:
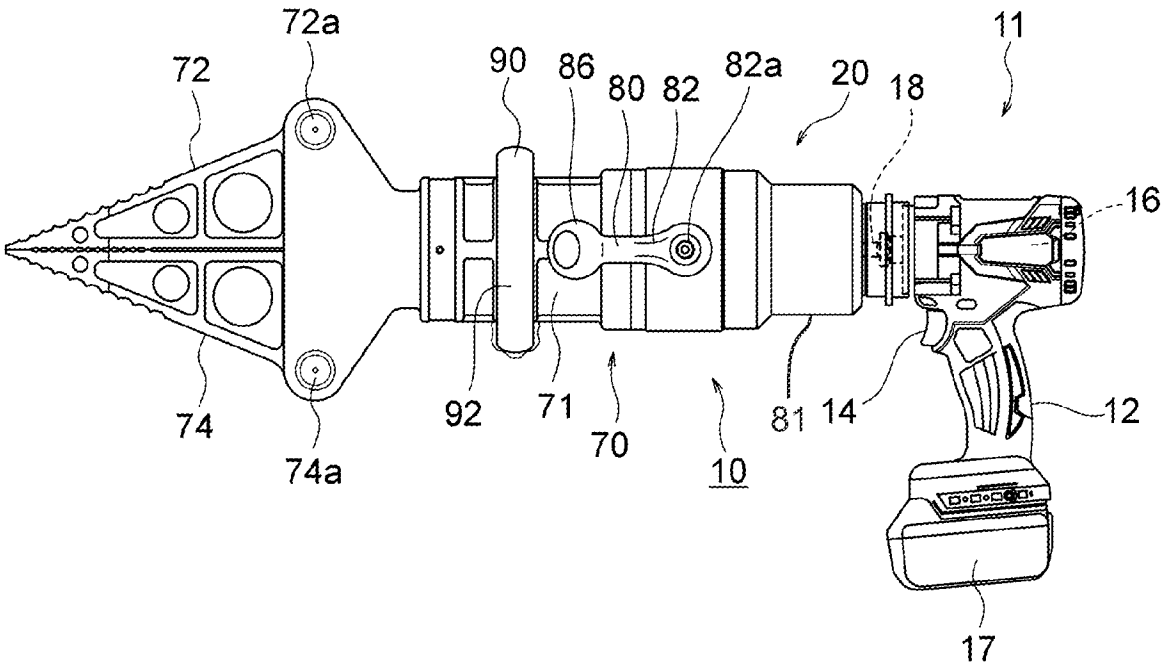
FIG. 1 is a front view illustrating the structure of a hydraulic device according to an embodiment of the present invention.
Figure 2:
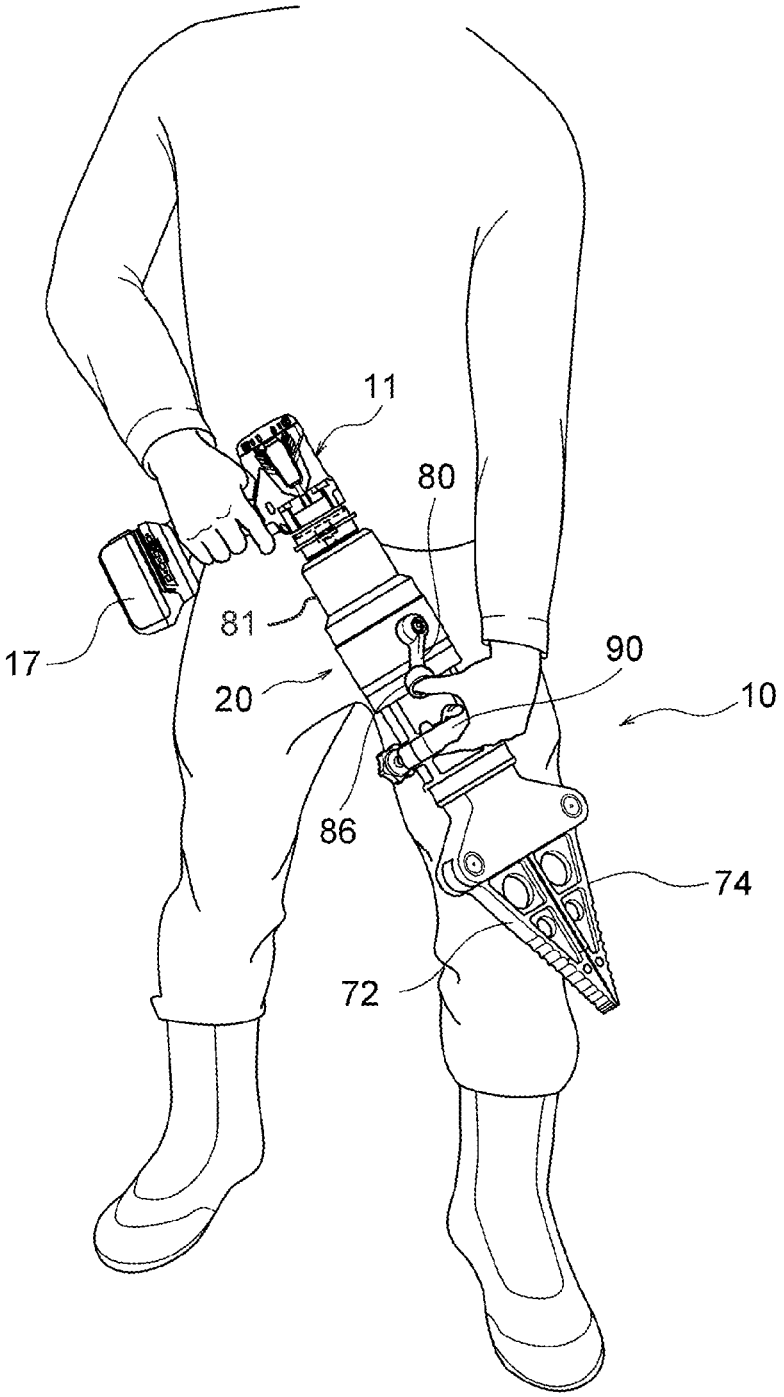
FIG. 2 illustrates a state where, with the hydraulic device shown in FIG. 1, a worker operates an operation part with a finger of the left hand when the worker is holding a grip portion with the right hand and is grasping a handle with the left hand.
Figure 3:
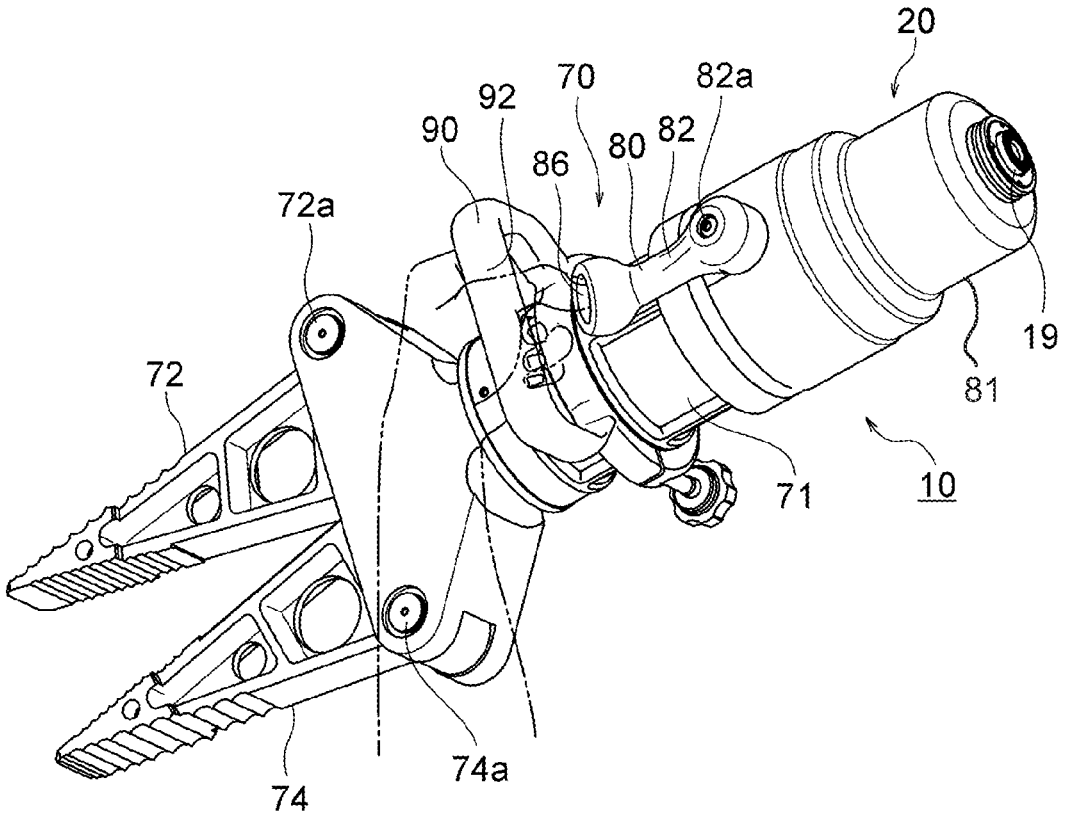
FIG. 3 is a perspective view illustrating a structure when a drive unit is detached from a main body of the hydraulic device shown in FIG. 1.
Figure 4:
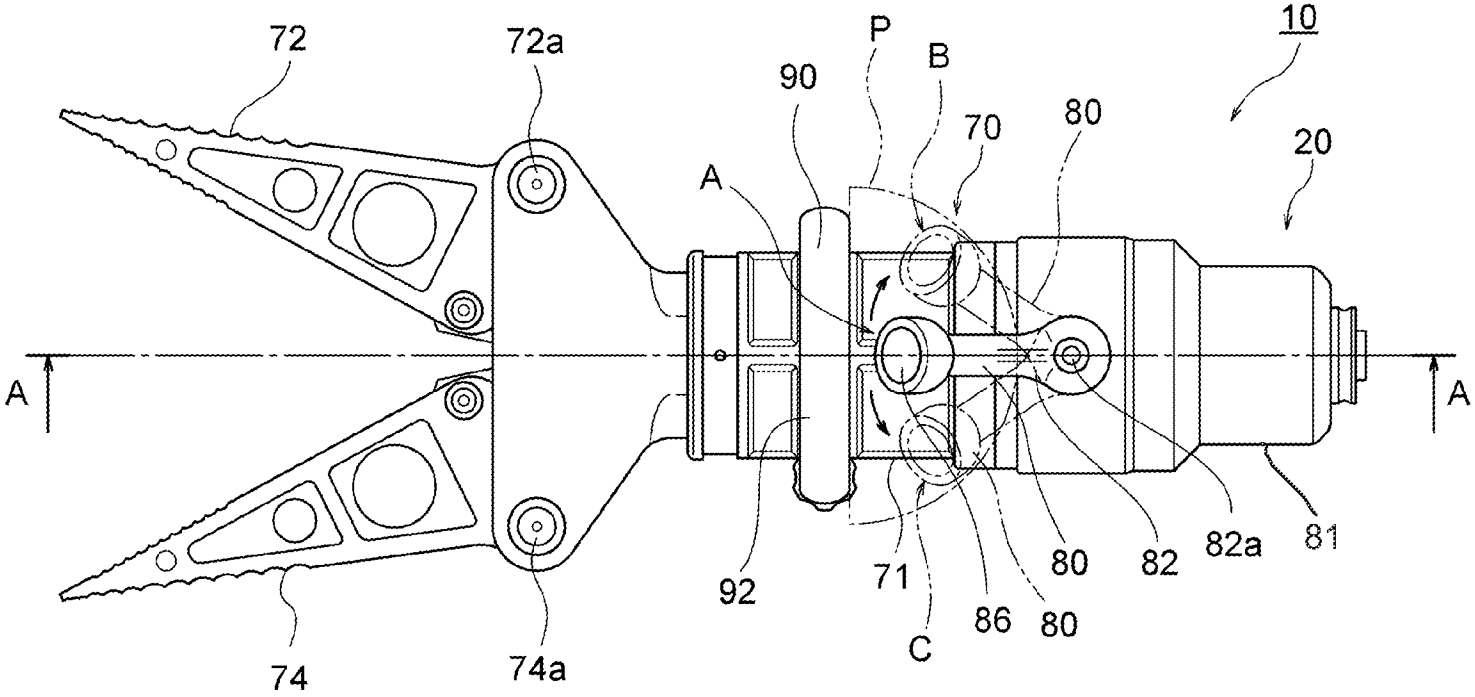
FIG. 4 is a front view of the hydraulic device shown in FIG. 1.
Figure 5:
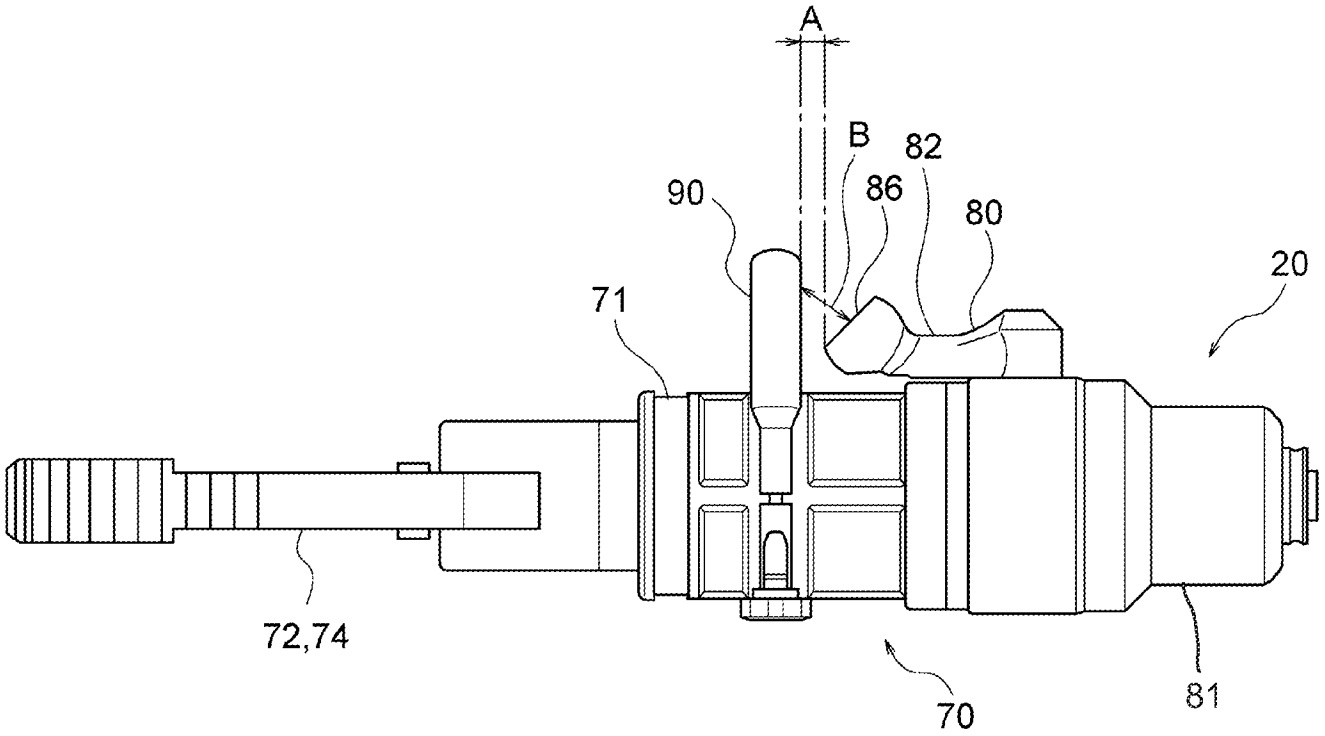
FIG. 5 is a bottom view of the hydraulic device shown in FIG. 1.
Figure 6:
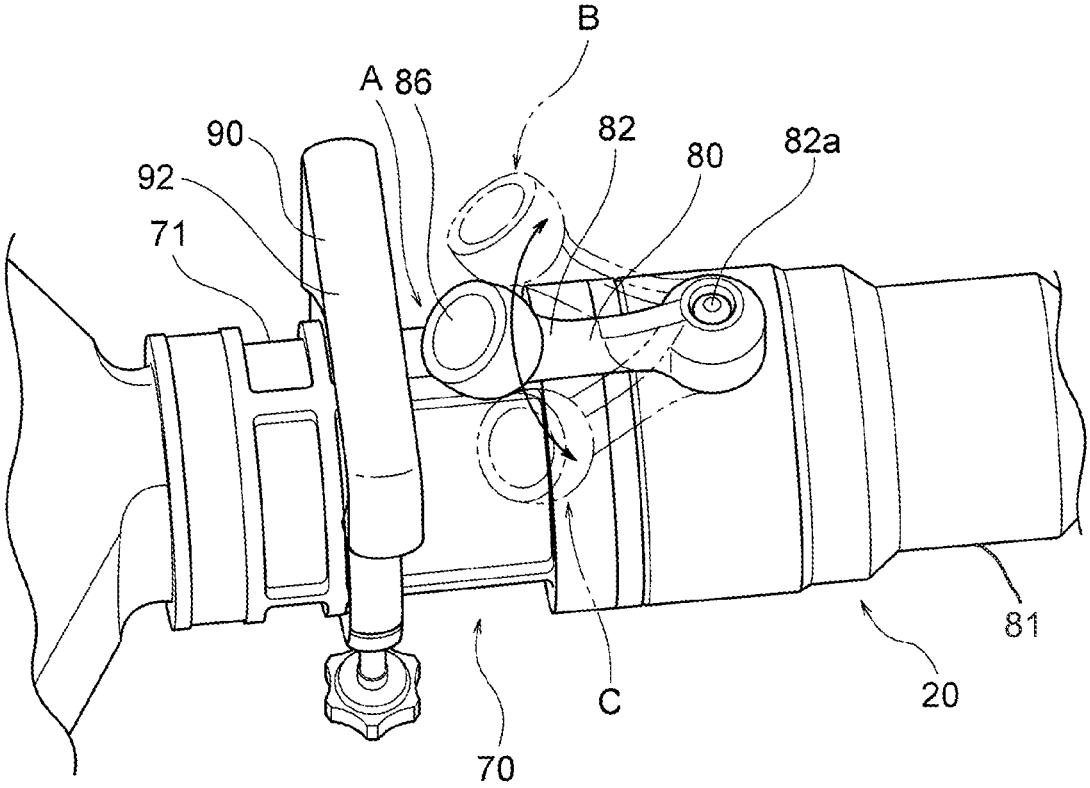
FIG. 6 is a perspective view illustrating movement of the operation part of the hydraulic device shown in FIG. 1.
Figure 7:
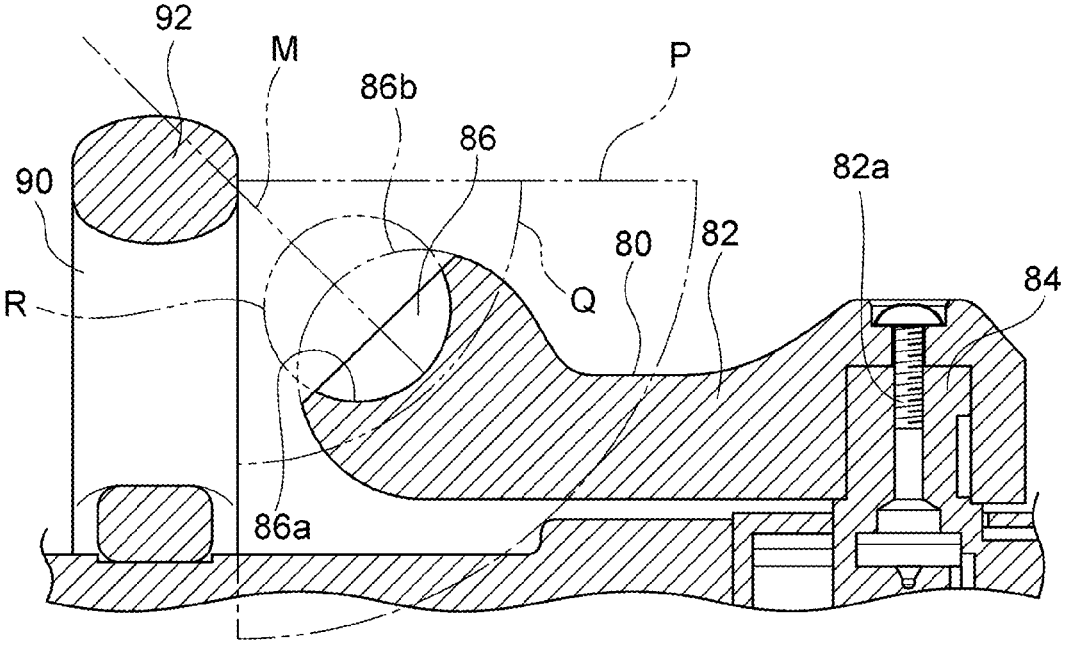
FIG. 7 is a cross-sectional view illustrating the structure of the operation part of the hydraulic device shown in FIG. 1.
Figure 8:
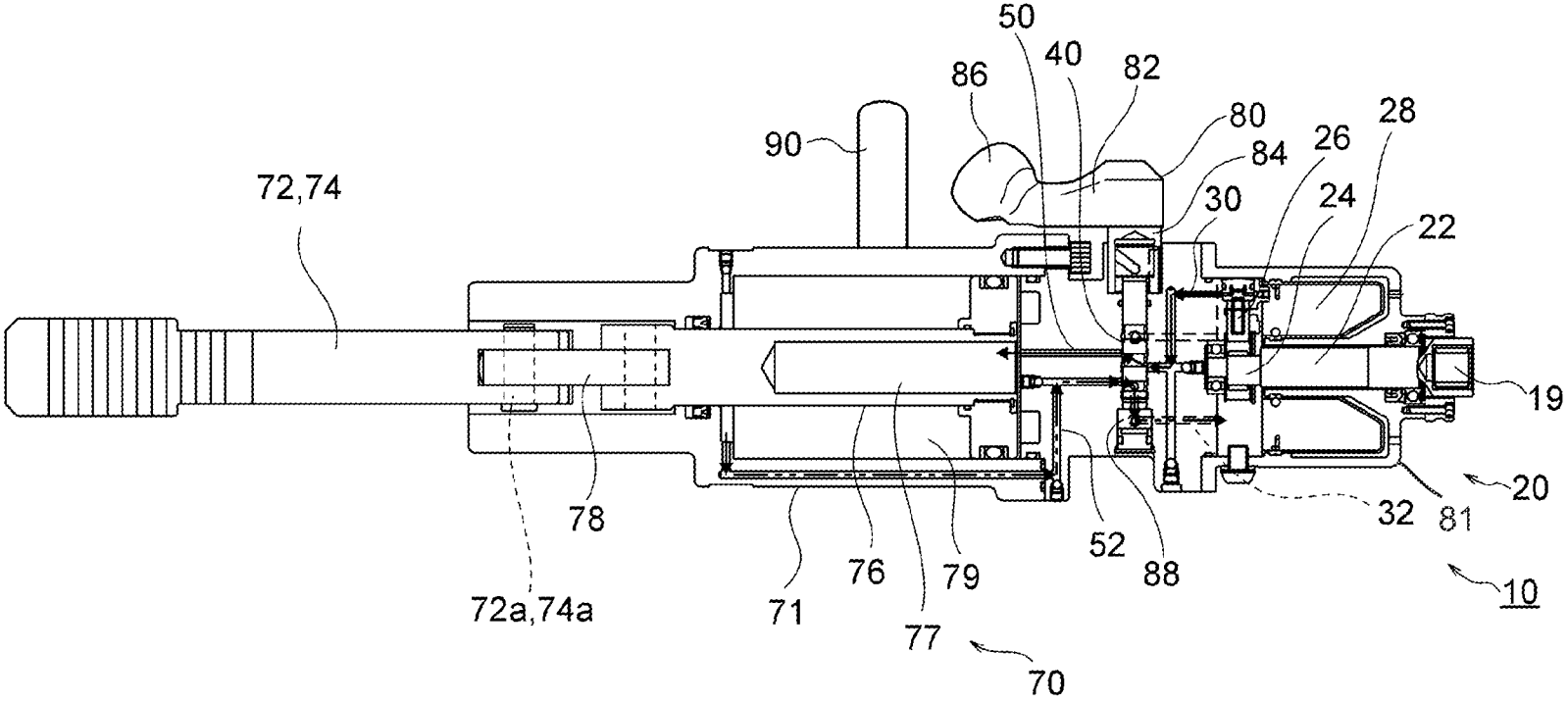
FIG. 8 is a side cross-sectional view of the hydraulic device shown in FIG. 4 as viewed from the direction of arrows A-A, and illustrates an internal structure when a switching part is located at an advance position.
Figure 9:
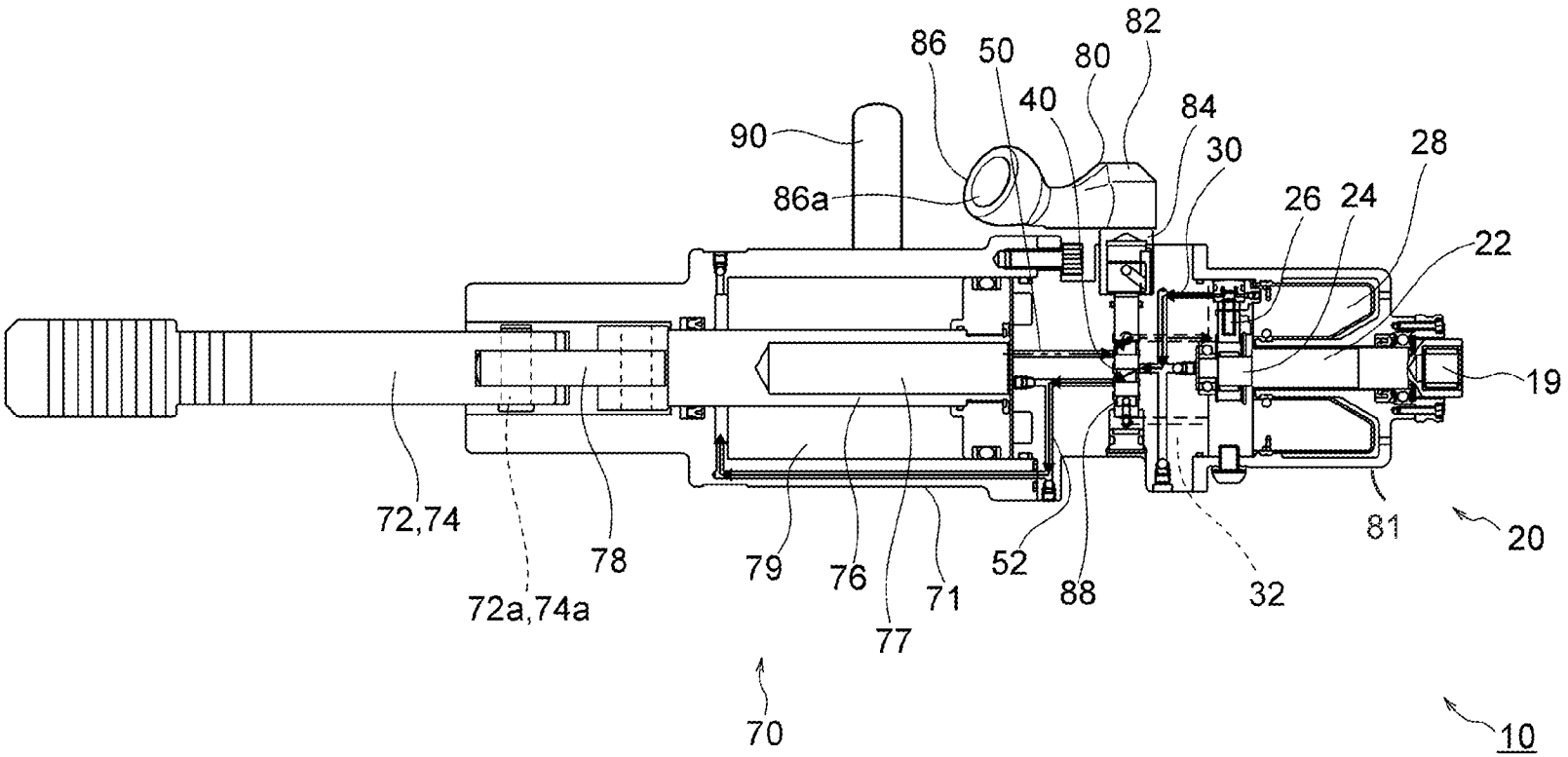
FIG. 9 is a side cross-sectional view of the hydraulic device shown in FIG. 4 as viewed from the direction of the arrows A-A, and illustrates an internal structure when the switching part is located at a retraction position.
Figure 10:
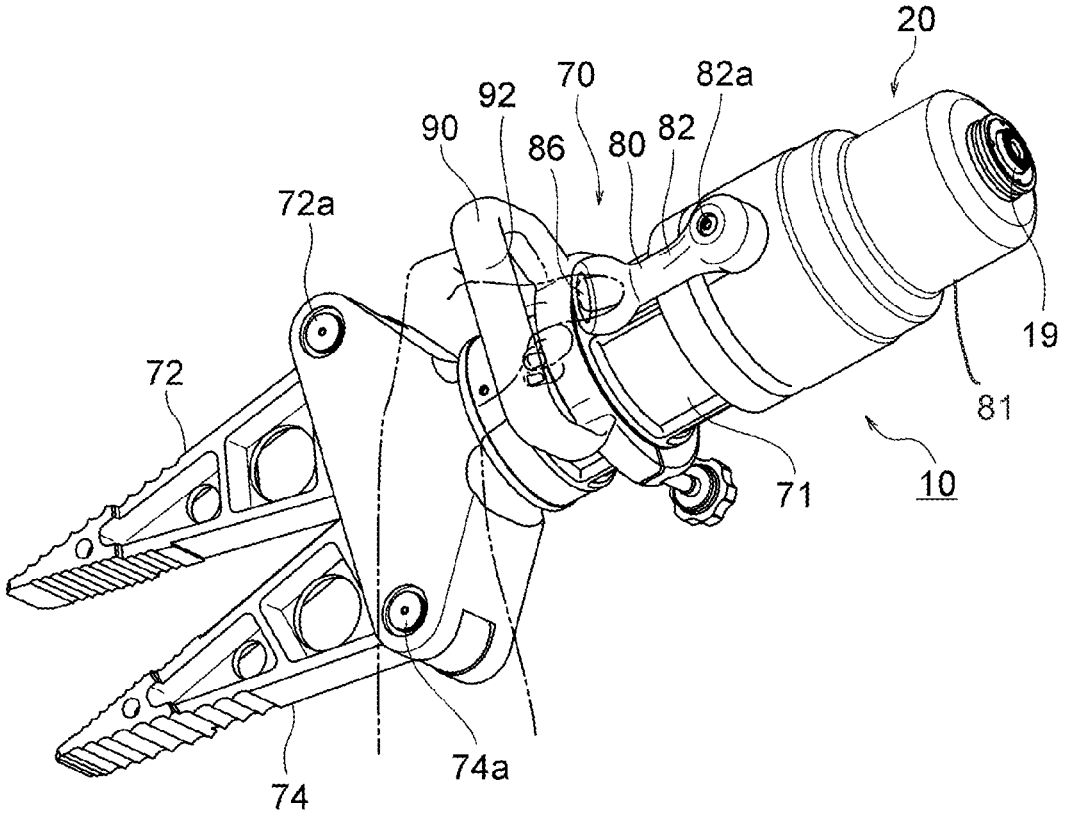
FIG. 10 is a perspective view illustrating another method for operating the operation part with the finger of the worker grasping the handle of the hydraulic device shown in FIG. 1.
Figure 11:
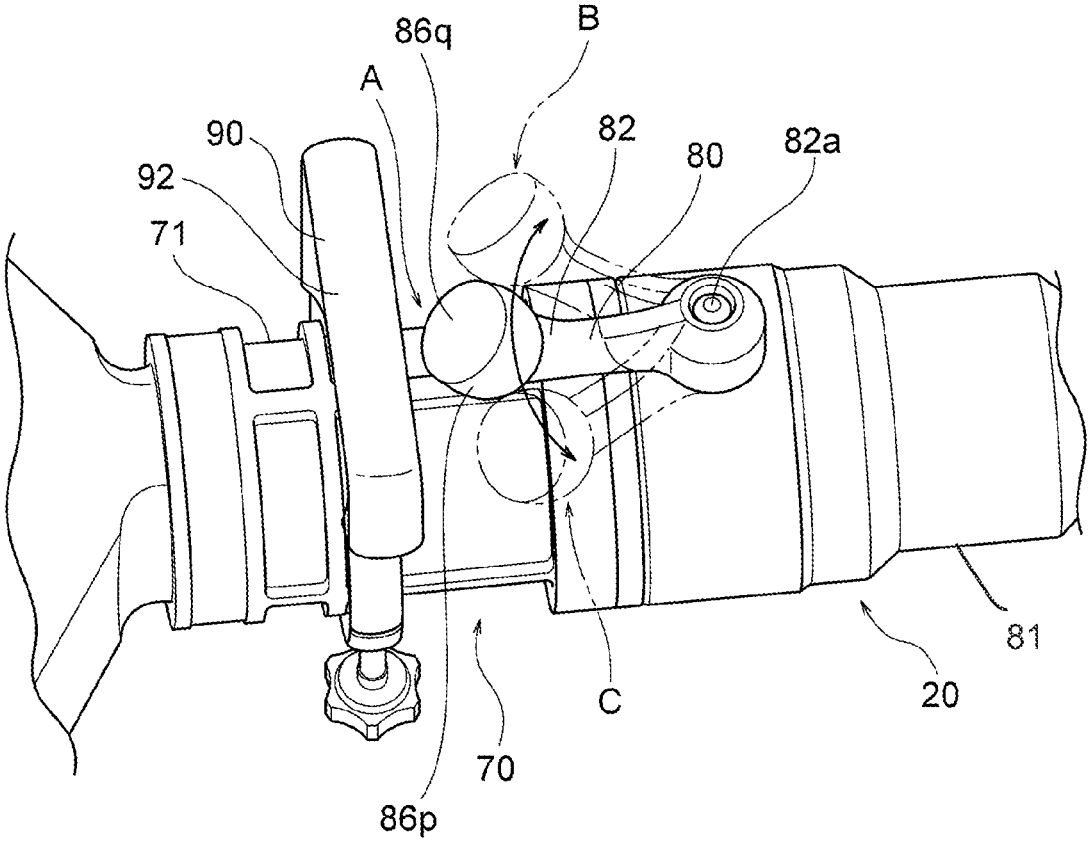
FIG. 11 is a perspective view illustrating another structure example of an operation portion of the operation part of the hydraulic device shown in FIG. 1.
Figure 12:
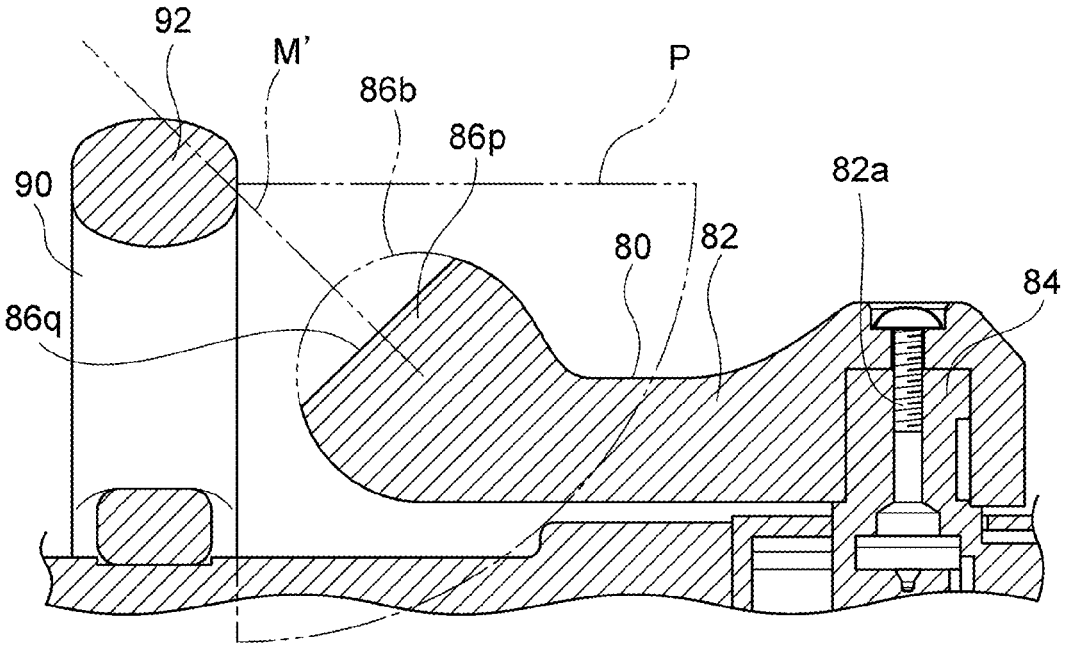
FIG. 12 is a cross-sectional view illustrating the structure of the operation portion of the operation part shown in FIG. 11.

Hereinafter, an embodiment of the present invention will be described with reference to the drawings. A hydraulic device according to the present embodiment is used for purposes such as rescue, and is capable of cutting an object such as a reinforcing bar, or prying open a gap of an object such as a door, with a tip tool such as a spreader. FIGS. 1 to 12 illustrate the hydraulic device according to the present embodiment. Among them, FIG. 1 is a front view illustrating the structure of the hydraulic device according to the present embodiment, and FIG. 2 illustrates a state where, with the hydraulic device shown in FIG. 1, a worker operates an operation part with a finger of the left hand when the worker is holding a grip portion with the right hand and is grasping a handle with the left hand. FIG. 3 is a perspective view illustrating a structure when a drive unit is detached from a main body of the hydraulic device shown in FIG. 1. FIG. 4 is a front view of the hydraulic device shown in FIG. 1, and FIG. 5 is a bottom view of the hydraulic device shown in FIG. 1. FIG. 6 is a perspective view illustrating movement of the operation part of the hydraulic device shown in FIG. 1, and FIG. 7 is a cross-sectional view illustrating the structure of the operation part of the hydraulic device shown in FIG. 1. FIGS. 8 and 9 are each a side cross-sectional view of the hydraulic device shown in FIG. 4 as viewed from the direction of arrows A-A, and illustrate internal structures when a switching part is located at an advance position and a retraction position, respectively. In FIGS. 8 and 9, pressure oil that should be sent from a hydraulic pump to a tip tool is indicated by a solid line, and return oil that should be returned from the tip tool to the hydraulic pump is indicated by an alternate long and two short dashes line. In addition, in FIGS. 8 and 9, in order to make it easier to see the switching part and oil passages for the pressure oil and the return oil which are disposed between the hydraulic pump and the tip tool, hatching for showing cross-sections at locations around the oil passages and the switching part is omitted. FIG. 10 is a perspective view illustrating another method for operating the operation part with the finger of the worker grasping the handle of the hydraulic device shown in FIG. 1. FIG. 11 is a perspective view illustrating another structure example of an operation portion of the operation part of the hydraulic device shown in FIG. 1, and FIG. 12 is a cross-sectional view illustrating the structure of the operation portion of the operation part shown in FIG. 11.

As shown in FIGS. 1 and 3, etc., the hydraulic device 10 of the present embodiment includes a drive unit 11, a hydraulic pump 20, and a tip tool 70. The drive unit 11 has a grip portion 12 to be held by the worker with one hand (for example, the right hand), a switch 14 which is operated by a finger of the right hand of the worker grasping the grip portion 12 with the right hand, a motor 16 such as an electric motor, and a battery 17 composed of a secondary battery such as a lithium ion battery or a nickel hydrogen battery. In addition, the drive unit 11 is detachable from the main body 81 of the hydraulic device 10. FIGS. 3 to 12 illustrate a state where the drive unit 11 is detached from the main body 81 of the hydraulic device 10. In addition, when the drive unit 11 is attached to the main body 81 of the hydraulic device 10, the hydraulic pump 20 is driven by the motor 16. More specifically, when the switch 14 is operated with the finger of the right hand of the worker grasping the grip portion 12 with the right hand, power is supplied from the battery 17 to the motor 16, and a rotation shaft 18 attached to the motor 16 is rotated by the motor 16. Moreover, as shown in FIG. 3, the hydraulic device 10 is provided with an insertion part 19 into which the rotation shaft 18 is inserted.

As shown in FIGS. 8 and 9, the hydraulic pump 20 has an oil chamber 28, a cylindrical rotation member 22, an eccentric member 24 which is attached to an end of the rotation member 22, and a piston 26 which moves up and down by rotation of the eccentric member 24. Here, the insertion part 19 is attached to the rotation member 22, and, when the rotation shaft 18 attached to the motor 16 of the drive unit 11 is inserted into the insertion part 19, the rotation member 22 rotates integrally with the rotation shaft 18 when the rotation shaft 18 is rotated by the motor 16. In addition, the eccentric member 24 is eccentric with respect to the axis of the rotation member 22, and a bearing such as a needle roller bearing is mounted on the outer circumferential surface of the eccentric member 24. The piston 26 is constantly pressed toward the outer circumferential surface of the bearing by a spring which is not shown. Thus, when the rotation member 22 rotates, the eccentric member 24 and the bearing make eccentric rotation motion relative to the axis of the rotation member 22, whereby the piston 26 moves up and down, the pressure oil is sent from the oil chamber 28 toward the tip tool 70, and the tip tool 70 is operated.

Moreover, as shown in FIGS. 8 and 9, a plurality of oil passages 30, 32, 50, and 52 for sending the pressure oil from the oil chamber 28 of the hydraulic pump 20 to the tip tool 70 and returning the return oil from the tip tool 70 to the oil chamber 28 are disposed within the hydraulic device 10. Here, among the plurality of oil passages 30, 32, 50, and 52, the first oil passage 30 is a feed pipe through which the pressure oil sent from the oil chamber 28 of the hydraulic pump 20 toward the tip tool 70 passes, and the second oil passage 32 is a return pipe through which the return oil returned from the tip tool 70 to the oil chamber 28 passes. Each of the first oil passage 30 and the second oil passage 32 communicates with a hole 40 into which a later-described switching part 88 is inserted. In addition, among the plurality of oil passages 30, 32, 50, and 52, the third oil passage 50 is a feed pipe for sending the pressure oil to an oil chamber 77 formed inside a later-described piston member 76 of the tip tool 70, and the fourth oil passage 52 is a feed pipe for sending the pressure oil to an oil chamber 79 formed outside the piston member 76. The third oil passage 50 and the fourth oil passage 52 also communicate with the hole 40 into which the switching part 88 is inserted. Each of oil passages that communicate with the first oil passage 30 and the second oil passage 32, respectively, is switched between the third oil passage 50 and the fourth oil passage 52 by the switching part 88.

Next, the structure of the tip tool 70 will be described in detail with reference to FIGS. 1, 4, 8, 9, etc. The tip tool 70 has a pair of prying members 72 and 74 which are rotatable about shafts 72*a* and 74*a*, respectively, a cylindrical cylinder 71, the piston member 76 which is disposed within the cylinder 71, and a connection member 78. When the pressure oil is sent from the hydraulic pump 20 to the tip tool 70, the piston member 76 is pushed out toward the left side in FIGS. 8 and 9. Each of the prying members 72 and 74 and the piston member 76 are connected to each other by the connection member 78. Thus, when the piston member 76 is pushed out toward the left side in FIGS. 8 and 9, the connection member 78 also moves leftward in FIGS. 8 and 9, whereby the respective prying members 72 and 74 rotate about the shafts 72*a* and 74*a*, and tip portions of the pair of prying members 72 and 74 become opened. As described above, after the tip portions of the respective prying members 72 and 74 are put in a gap of an object that should be pried open by the tip tool 70, the tip portions of the pair of prying members 72 and 74 can be opened by sending the pressure oil from the hydraulic pump 20 to the tip tool 70, thereby widening the gap of the object.

More specifically, the oil chamber 77 is formed inside the piston member 76 in the tip tool 70, and the piston member 76 moves toward the left side in FIGS. 8 and 9 when the pressure oil is sent from the third oil passage 50 to the oil chamber 77. In addition, the oil chamber 79 is also formed outside the piston member 76, and the piston member 76 moves toward the right side in FIGS. 8 and 9 when the pressure oil is sent from the fourth oil passage 52 to the oil chamber 79.

Moreover, the hydraulic device 10 of the present embodiment is provided with a handle 90 which is held with the hand opposite to the hand of the worker grasping the grip portion 12 (for example, with the left hand), the switching part 88 such as a spool which switches a path for at least one of the pressure oil and the return oil, and an operation part 80 for operating the switching part 88. The handle 90 has a bar-like portion 92 which extends in a direction orthogonal to the longitudinal direction of the hydraulic device 10 (that is, to the direction of reciprocation of the piston member 76). When the worker performs work with the hydraulic device 10 in which the drive unit 11 is attached to the main body 81, since the weight of the hydraulic device 10 is large, the worker holds the grip portion 12 with the right hand and holds the handle 90 with the left hand as shown in FIG. 2. Moreover, the operation part 80 is disposed at a position that allows the operation part 80 to be operated with the hand of the worker holding the bar-like portion 92 of the handle 90 (more specifically, with the left hand), or with a finger of the hand holding the bar-like portion 92 of the handle 90. Specifically, the phrase "the operation part 80 is disposed at a position that allows the operation part 80 to be operated with the hand of the worker holding the bar-like portion 92 of the handle 90, or with a finger of the hand holding the bar-like portion 92 of the handle 90" means that the distance between the handle 90 and the operation part 80 in the longitudinal direction of the hydraulic device 10 (that is, the direction of reciprocation of the piston member 76) (that is, a distance indicated by reference character A in FIG. 5) falls within the range of 0 mm to 50 mm, preferably falls within the range of 5 mm to 50 mm, and further preferably falls within the range of 9 mm to 45 mm.

Figure 23:
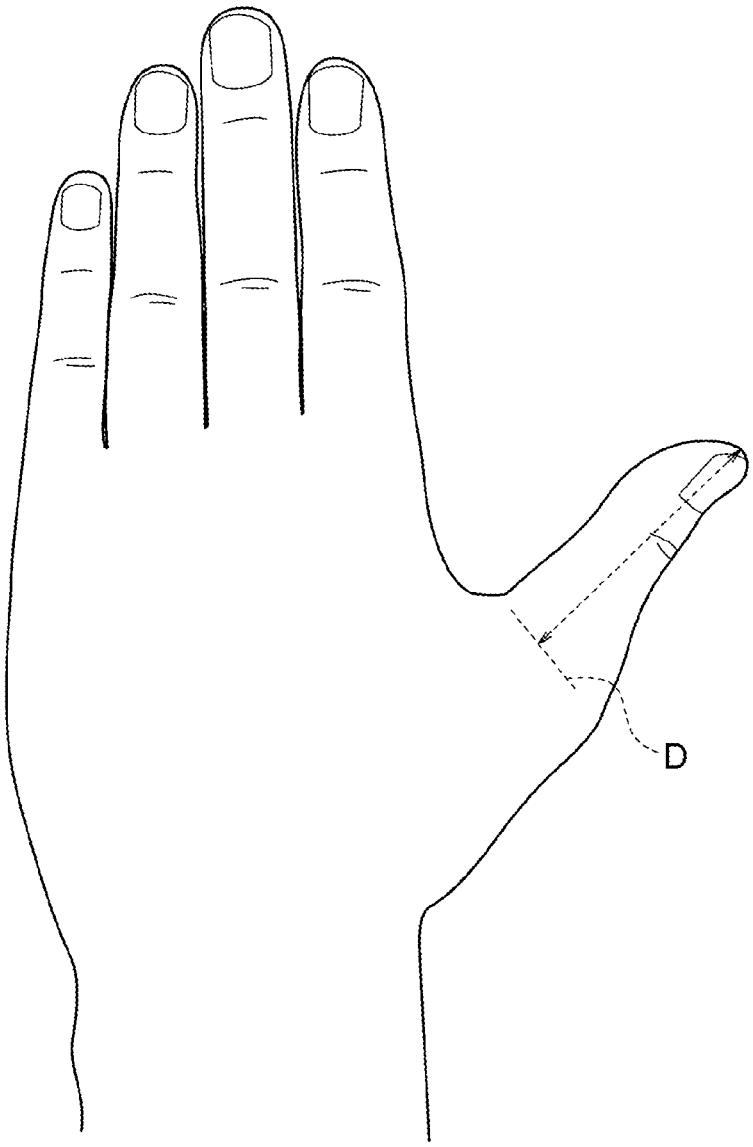
FIG. 23 illustrates the direct distance from a wrinkle at the base of a thumb to the tip of the thumb in a state where the palm of a left hand is spread, the fingers of the hand are stretched, the four fingers other than the thumb are aligned, and the thumb is spread outward.

In more detail, as shown in FIG. 23, regarding the dimension data of the hands of the Japanese, in a state where the palm of a hand is spread, the fingers of the hand are stretched, the four fingers other than the thumb are aligned, and the thumb is spread outward, the direct distance from a wrinkle (indicated by reference character D) at the base of the thumb to the tip of the thumb (this distance is also referred to as a first finger length) is 48.5 mm at minimum, 59.0 mm on average, and 75.5 mm at maximum. Regarding the dimension data of non-Japanese hands, such a first finger length may be slightly larger than that of the dimension data of the hands of the Japanese. When the distance between the handle 90 and the operation part 80 in the longitudinal direction of the hydraulic device 10 is greater than 50 mm, if the worker has hands with a short first finger length, there is a possibility that the hand of the worker holding the bar-like portion 92 of the handle 90 or the finger of the hand does not reach the operation part 80. Thus, the distance between the handle 90 and the operation part 80 in the longitudinal direction of the hydraulic device 10 is preferably not greater than 50 mm. When the distance between the handle 90 and the operation part 80 in the longitudinal direction of the hydraulic device 10 is not greater than 45 mm, the hand of the worker holding the bar-like portion 92 of the handle 90 or the finger of the hand further assuredly reaches the operation part 80. In addition, when the distance between the handle 90 and the operation part 80 in the longitudinal direction of the hydraulic device 10 is excessively short, if the worker has hands with a long first finger length, there is a problem that it becomes difficult to operate the operation part 80 with the hand of the worker holding the bar-like portion 92 of the handle 90, or with the finger of the hand, since the handle 90 and the operation part 80 are excessively close to each other. Here, when the distance between the handle 90 and the operation part 80 in the longitudinal direction of the hydraulic device 10 is not less than 5 mm, it becomes easy to operate the operation part 80 with the hand of the worker holding the bar-like portion 92 of the handle 90, or with the finger of the hand holding the bar-like portion 92 of the handle 90. Moreover, when the distance between the handle 90 and the operation part 80 in the longitudinal direction of the hydraulic device 10 is not less than 9 mm, it becomes easier to operate the operation part 80 with the hand of the worker holding the bar-like portion 92 of the handle 90, or with the finger of the hand holding the bar-like portion 92 of the handle 90.

When the above-described first finger length is taken into consideration, the shortest distance between the bar-like portion 92 of the handle 90 and an operation portion 86 of the operation part 80 (that is, a distance indicated by reference character B in FIG. 5) preferably ranges within the range of 5 mm to 50 mm, further preferably falls within the range of 5 mm to 45 mm, and particularly preferably falls within the range of 9 mm to 40 mm. When the shortest distance between the bar-like portion 92 of the handle 90 and the operation portion 86 of the operation part 80 is greater than 50 mm, if the worker has hands with a short first finger length, there is a possibility that the hand of the worker holding the bar-like portion 92 of the handle 90 or the finger of the hand does not reach the operation part 80. When the shortest distance between the bar-like portion 92 of the handle 90 and the operation portion 86 of the operation part 80 is less than 5 mm, if the worker has hands with a long first finger length, there is a problem that it becomes difficult to operate the operation part 80 with the hand of the worker holding the bar-like portion 92 of the handle 90, or with the finger of the hand holding the bar-like portion 92 of the handle 90, since the handle 90 and the operation part 80 are excessively close to each other.

Moreover, the distance from the main body 81 of the hydraulic device 10 (specifically, the cylindrical cylinder 71) to the bar-like portion 92 of the handle 90 is larger than the distance from the main body 81 of the hydraulic device 10 to the operation part 80.

The structures of such an operation part 80 and such a switching part 88 will be described in detail below.

As shown in FIGS. 4 to 7, the operation part 80 has a lever 82 which is operated by the worker, and a substantially cylindrical lever attachment part 84 to which the lever 82 is attached. More specifically, a shaft part 82*a* such as a screw is disposed at the lever 82, and the shaft part 82*a* is connected to the lever attachment part 84. The lever 82 is rotatable integrally with the lever attachment part 84 about the shaft part 82*a*. In addition, when the lever 82 is rotated by the worker, the switching part 88 advances and retracts in a direction orthogonal to the direction in which the lever 82 is rotated (specifically, in the up-down direction in FIGS. 8 and 9). The lever attachment part 84 is provided with a stopper groove (not shown), and a bolt (not shown) is inserted into the stopper groove. Here, the bolt is disposed at the hydraulic device 10 in a fixed manner. The rotation angle of the lever 82 and the lever attachment part 84 can be limited within a predetermined range by the stopper groove into which the bolt disposed at the hydraulic device 10 in a fixed manner is inserted. Specifically, the rotation angle of the lever 82 and the lever attachment part 84 can be limited, for example, within a range of 60°.

Moreover, a lead groove (not shown) is formed on the outer circumferential surface of the switching part 88 so as to be tilted relative to the circumferential direction and the axial direction of the switching part 88, and a tip portion of the above-described bolt is inserted into the lead groove. As described above, since the tip portion of the bolt disposed at the hydraulic device 10 in a fixed manner is inserted into the lead groove tilted relative to the axial direction of the switching part 88, when the lever attachment part 84 rotates, the switching part 88 advances and retracts along the axial direction (that is, the up-down direction in FIGS. 8 and 9). In addition, a groove into which an elongated cylindrical positioning pin (not shown) is fitted is formed on the outer circumferential surface of the switching part 88. Such a positioning pin can prevent the position in the circumferential direction of the switching part 88 from being displaced from the lever attachment part 84. That is, the lever attachment part 84 and the switching part 88 rotate in the same phase. Moreover, a plurality of grooves (not shown) are formed on the switching part 88, and a hole is formed in each groove. Here, a hollow portion is formed inside the switching part 88 so as to extend along the axial direction, and each hole communicates with the hollow portion. Furthermore, outer wall portions are formed between the respective grooves so as to extend in the circumferential direction.

Three grooves (not shown) are also formed on the outer circumferential surface of the lever attachment part 84. In addition, a steel ball (not shown) which enters any one of the three grooves and a pressing member (not shown) which presses the steel ball toward the lever attachment part 84 by a spring (not shown) are disposed. Since the steel ball is pressed toward the lever attachment part 84 by the pressing member through the spring, when the steel ball enters any one of the three grooves, the lever attachment part 84 is positioned at any one of an advance position, a neutral position, and a retraction position described later.

The switching part 88 having such a structure serves as a so-called spool valve.

As described above, the lever 82 rotates about the axis of the shaft part 82*a*. More specifically, as shown in FIG. 6, the lever 82 is rotatable about the axis of the shaft part 82*a* within a predetermined range. Here, the position of the operation part 80 shown in FIG. 4 is defined as the neutral position (a position A in FIGS. 4 and 6), the position at which the lever 82 cannot be further rotated when the lever 82 rotates clockwise about the axis of the shaft part 82*a* from the position shown in FIG. 4 is defined as the advance position (a position B in FIGS. 4 and 6), and the position at which the lever 82 cannot be further rotated when the lever 82 rotates counterclockwise about the axis of the shaft part 82*a* from the position shown in FIG. 4 is defined as the retraction position (a position C in FIGS. 4 and 6). As described above, in the present embodiment, the operation part 80 can be moved between the neutral position, the advance position, and the retraction position. In addition, when the lever 82 is located at the neutral position, the lever 82 extends from the shaft part 82*a* toward the handle 90, and the advance position and the retraction position of the lever 82 are located at the opposite sides with the neutral position interposed therebetween. In another structure example of the lever 82, the position of the operation part 80 shown in FIG. 4 may be defined as the neutral position, the position at which the lever 82 cannot be further rotated when the lever 82 rotates clockwise about the axis of the shaft part 82*a* from the position shown in FIG. 4 may be defined as the retraction position, and the position at which the lever 82 cannot be further rotated when the lever 82 rotates counterclockwise about the axis of the shaft part 82*a* from the position shown in FIG. 4 may be defined as the advance position. In still another structure example, a hydraulic device, in which the lever 82 is movable only between the advance position and the retraction position and there is no neutral position, may be used.

The lever 82 of the operation part 80 is provided with the operation portion 86 which is operated with the hand of the worker holding the handle 90, or with the finger of the hand holding the handle 90. As shown in FIG. 7, the operation portion 86 is formed by cutting a portion 86*b* from a substantially spherical body. In addition, the operation portion 86 has a curved recess 86*a*. If the worker has small hands, the thumb of the hand grasping the handle 90 is allowed to be put in the recess 86*a* as shown in FIG. 2. Here, as shown in FIG. 7, the recess 86*a* has a shape curved such that the recess 86*a* is a part of the spherical surface of a virtual sphere indicated by reference character R. In addition, when the recess 86*a* is a part of the spherical surface of the virtual sphere R, a line (indicated by reference character M in FIG. 7) connecting the center of the recess 86*a* to the center of the virtual sphere R is tilted relative to the longitudinal direction of the hydraulic device 10 (that is, the right-left direction in FIG. 7). Moreover, the line M connecting the center of the recess 86*a* to the center of the virtual sphere R extends from the recess 86*a* toward the bar-like portion 92 of the handle 90. Owing to the recess 86*a* having such a shape, the thumb of the hand grasping the handle 90 is easily put in the recess 86*a*, and thus the operability of the operation part 80 can be improved. In addition, when the line M connecting the center of the recess 86*a* to the center of the virtual sphere R extends from the recess 86*a* toward the bar-like portion 92 of the handle 90, the recess 86*a* is closer to the finger of the left hand of the worker holding the handle 90 with the left hand, so that operation force can be transmitted to the operation portion 86 by more natural movement of the finger of the left hand holding the handle 90.

As shown in FIGS. 4 and 7, even when the lever 82 is located at any position, the operation portion 86 is located within the range of a region (indicated by reference character P) obtained by cutting a virtual sphere that has a predetermined size (for example, 75 mm) and that is centered at the side edge, closer to the operation part 80, of the bar-like portion 92 of the handle 90, into ¼. In addition, as shown in FIG. 7, when the lever 82 is located at the center position, the recess 86*a* of the operation portion 86 is located within the range of a region (indicated by reference character Q) obtained by cutting a virtual sphere that has another predetermined size (for example, 50 mm) and that is centered at the side edge, closer to the operation part 80, of the bar-like portion 92 of the handle 90, into ¼. In this case as well, the thumb of the hand grasping the handle 90 is easily put in the recess 86*a*, and thus the operability of the operation part 80 can be improved.

If the worker has big hands, the worker can operate the lever 82 by hooking the thumb of the hand grasping the handle 90, on an outer portion of the operation portion 86 as shown in FIG. 10. In addition, if the worker has bigger hands, the worker may operate a center portion of the lever 82 with the palm or the like of the hand grasping the handle 90, not with the finger of the hand. In this manner, the worker grasping the handle 90 with the hand is allowed to rotate the lever 82 between the neutral position, the advance position, and the retraction position with the hand grasping the handle 90, or with the finger of the hand grasping the handle 90, without releasing the hand from the handle 90.

The operation portion of the operation part 80 is not limited to the operation portion having the structure shown in FIGS. 1 to 7. As the operation portion of the operation part 80, an operation portion that is formed by cutting a portion from a substantially spherical body and on which no recess is formed may be used. The structure of such an operation portion of the operation part 80 will be described with reference to FIGS. 11 and 12.

As shown in FIGS. 11 and 12, an operation portion 86*p* according to another example is formed by cutting a portion 86*b* from a substantially spherical body. No recess is formed on the operation portion 86*p*, and the operation portion 86*p* has a circular flat surface 86*q* formed at a location where the portion 86*b* is cut from the substantially spherical body. In addition, a line (indicated by reference character M' in FIG. 12) that passes through the center of the flat surface 86*q* and that is orthogonal to the flat surface 86*q* is tilted relative to the longitudinal direction of the hydraulic device 10 (that is, the right-left direction in FIG. 12). Moreover, the line M', which passes through the center of the flat surface 86*q* and which is orthogonal to the flat surface 86*q*, extends from the flat surface 86*q* toward the bar-like portion 92 of the handle 90. Even with the operation portion 86*p* having such a shape, the operability of the operation part 80 can be improved by bringing the thumb of the hand grasping the handle 90 into contact with the flat surface 86*q* of the operation portion 86*p*. Furthermore, when the line M', which is orthogonal to the flat surface 86*q*, extends from the flat surface 86*q* toward the bar-like portion 92 of the handle 90, the flat surface 86*q* is closer to the finger of the left hand of the worker holding the handle 90 with the left hand, so that operation force can be transmitted to the operation portion 86*p* by more natural movement of the finger of the left hand holding the handle 90.

As shown in FIG. 12, even when the lever 82 is located at any position, the operation portion 86 is located within the range of a region (indicated by reference character P) obtained by cutting a virtual sphere that has a predetermined size (for example, 75 mm) and that is centered at the side edge, closer to the operation part 80, of the bar-like portion 92 of the handle 90, into ¼. Accordingly, the thumb of the hand grasping the handle 90 is easily brought into contact with the flat surface 86*q* of the operation portion 86*p*, and thus the operability of the operation part 80 can be improved.

As shown in FIGS. 8 and 9, the hole 40 into which the switching part 88 is inserted is formed in the hydraulic device 10, and each of the above-described oil passages 30, 32, 50, and 52 communicates with the hole 40. Here, a plurality of grooves are also formed on a peripheral wall of the hole 40 so as to extend along the circumferential direction of the hole 40, and some of the grooves are closed by the respective outer wall portions of the switching part 88 when the later-described operation part 80 is located at the neutral position. Meanwhile, when the later-described operation part 80 is located at the advance position or the retraction position, all the grooves are not closed by the respective outer wall portions of the switching part 88, but become opened. In addition, in the present embodiment, the position of the switching part 88 in the up-down direction in FIGS. 8 and 9 changes depending on the position of the operation part 80. Thus, each of the oil passages that communicate with the first oil passage 30 and the second oil passage 32, respectively, is switched between the third oil passage 50 and the fourth oil passage 52.

Next, operation of the hydraulic device 10 configured as described above will be described below.

First, operation performed when prying open a gap of an object with the tip tool 70 will be described with reference to FIG. 8. At a rescue site, after the drive unit 11 is attached to the main body 81 of the hydraulic device 10, the worker holds the grip portion 12 of the drive unit 11 with one hand (for example, the right hand) and grasps the handle 90 of the hydraulic device 10 with the other hand (for example, the left hand) as shown in FIG. 2. Then, when prying open the gap of the object with the tip tool 70, the worker rotates the operation part 80 with the left hand holding the handle 90, or with the finger of the left hand holding the handle 90, to move the operation part 80 from the neutral position to the advance position. Specifically, when the hydraulic device 10 is on standby, the operation part 80 is located at the neutral position, and, when the worker rotates the lever 82 clockwise about the axis of the shaft part 82*a* with the palm or the finger of the left hand from such a state, the lever 82 is located at the advance position. In addition, when the lever 82 is rotated to the advance position, the lever attachment part 84 also integrally rotates, and the tip portion of the bolt moves relatively within the lead groove, whereby the switching part 88 moves upward in FIG. 8 along the axial direction. When the switching part 88 moves upward in FIG. 8 along the axial direction as described above, the position of each groove formed on the outer circumferential surface of the switching part 88 changes, and the grooves in the hole 40 that have been closed by the switching part 88 become opened, whereby the first oil passage 30 and the third oil passage 50, which are feed pipes, communicate with each other (see FIG. 8). Accordingly, when the hydraulic pump 20 is activated and the pressure oil is sent from the oil chamber 28 of the hydraulic pump 20 to the first oil passage 30, the pressure oil is sent from the third oil passage 50 to the oil chamber 77 of the tip tool 70. When the pressure oil is sent from the third oil passage 50 to the oil chamber 77 as described above, the piston member 76 moves toward the left side in FIG. 8, and the connection member 78 advances leftward in FIG. 8, whereby the respective prying members 72 and 74 become opened about the shafts 72*a* and 74*a*. In this manner, the tip portions of the prying members 72 and 74 fitted into the gap of the object that should be pried open with the tip tool 70 become opened, whereby the gap of the object can be widened.

Moreover, when the switching part 88 moves upward in FIG. 8 along the axial direction, the position of each groove formed on the outer circumferential surface of the switching part 88 changes, and the grooves in the hole 40 that have been closed by the switching part 88 become opened, whereby the second oil passage 32, which is a return pipe, and the fourth oil passage 52 communicate with each other (see FIG. 8). Accordingly, the return oil sent from the oil chamber 79, which is formed outside the piston member 76 in the tip tool 70, to the fourth oil passage 52 is returned from the second oil passage 32 to the oil chamber 28 of the hydraulic pump 20.

Next, operation performed when stopping the piston member 76 in the tip tool 70 will be described. When stopping the piston member 76 in the tip tool 70, the worker rotates the operation part 80 with the palm or the finger of the left hand holding the handle 90, to move the operation part 80 to the neutral position. Specifically, the worker rotates the lever 82 to the position indicated by reference character A in FIG. 6. Here, when the lever 82 is rotated to the neutral position, the lever attachment part 84 also integrally rotates, and the switching part 88 is also located at the center position. At this time, some of the plurality of grooves, on the peripheral wall of the hole 40, extending along the circumferential direction, are closed by the respective outer wall portions of the switching part 88. Here, the grooves closed by the respective outer wall portions of the switching part 88 communicate with the third oil passage 50 and the fourth oil passage 52, respectively. Thus, since the grooves that communicate with the third oil passage 50 and the fourth oil passage 52 are closed by the respective outer wall portions of the switching part 88, each of the third oil passage 50 and the fourth oil passage 52 no longer communicates with the first oil passage 30 or the second oil passage 32. In addition, the pressure oil is returned from the first oil passage 30 to the oil chamber 28 of the hydraulic pump 20 by a valve which is not shown. Accordingly, the pressure oil is no longer sent from the third oil passage 50 and the fourth oil passage 52 to the oil chambers 77 and 79 of the tip tool 70, and thus the piston member 76 cannot be moved.

Next, operation performed when causing the piston member 76 in the tip tool 70 to retract to return the respective prying members 72 and 74 to the closed position will be described with reference to FIG. 9. When returning the tip tool 70 to the initial state, the worker rotates the operation part 80 with the palm or the finger of the left hand holding the handle 90, to move the operation part 80 from the neutral position to the retraction position. Specifically, when the worker rotates the lever 82 counterclockwise about the axis of the shaft part 82*a*, the lever 82 is located at the retraction position. In addition, when the lever 82 is rotated to the retraction position, the lever attachment part 84 also integrally rotates, and the tip portion of the bolt moves relatively within the lead groove, whereby the switching part 88 moves downward in FIG. 9 along the axial direction. When the switching part 88 moves downward in FIG. 9 along the axial direction as described above, the position of each groove formed on the outer circumferential surface of the switching part 88 changes, and the grooves in the hole 40 that have been closed by the switching part 88 become opened, whereby the first oil passage 30 and the fourth oil passage 52, which are feed pipes, communicate with each other (see FIG. 9). Accordingly, when the hydraulic pump 20 is activated and the pressure oil is sent from the oil chamber 28 of the hydraulic pump 20 to the first oil passage 30, the pressure oil is sent from the fourth oil passage 52 to the oil chamber 79 of the tip tool 70. When the pressure oil is sent from the fourth oil passage 52 to the oil chamber 79 as described above, the piston member 76 moves toward the right side in FIG. 9, and the connection member 78 moves rightward in FIG. 9, whereby the respective prying members 72 and 74 are rotated about the shafts 72*a* and 74*a* in a direction in which the prying members 72 and 74 come close to each other. In this manner, the tip tool 70 can be returned to the initial state.

Moreover, when the switching part 88 moves downward in FIG. 9 along the axial direction, the position of each groove formed on the outer circumferential surface of the switching part 88 changes, and the grooves in the hole 40 that have been closed by the switching part 88 become opened, whereby the second oil passage 32, which is a return pipe, and the third oil passage 50 communicate with each other (see FIG. 9). Accordingly, the return oil sent from the oil chamber 77 in the tip tool 70 to the third oil passage 50 is returned from the second oil passage 32 to the oil chamber 28 of the hydraulic pump 20.

The hydraulic device 10 of the present embodiment configured as described above is provided with the handle 90 which is held by one hand (for example, the left hand) of the worker, the switching part 88 which is disposed at the oil passages 30, 32, 50, and 52 and which switches the paths for the pressure oil and the return oil, and the operation part 80 for operating the switching part 88, and the operation part 80 is disposed at a position that allows the operation part 80 to be operated with the hand of the worker holding the handle 90, or with the finger of the hand holding the handle 90. Specifically, the distance between the handle 90 and the operation part 80 in the longitudinal direction of the hydraulic device 10 falls within the range of 0 mm to 50 mm. In addition, the handle 90 has the bar-like portion 92 extending in the direction orthogonal to the longitudinal direction of the hydraulic device 10, and the worker is allowed to operate the operation part 80 with the hand grasping the bar-like portion 92 of the handle 90, or with the finger of the hand grasping the bar-like portion 92 of the handle 90. Moreover, the distance from the main body 81 of the hydraulic device 10 to the bar-like portion 92 of the handle 90 is larger than the distance from the main body 81 of the hydraulic device 10 to the operation part 80. Owing to these technical matters, when performing work with the tip tool 70 by holding the grip portion 12 close to the electric motor with one hand and grasping the handle 90 with the other hand, the worker can operate the operation part 80 with the hand of the worker holding the handle 90, or with the finger of the hand holding the handle 90, without releasing the hand from the handle 90, and thus the workability can be improved.

Figure 13:
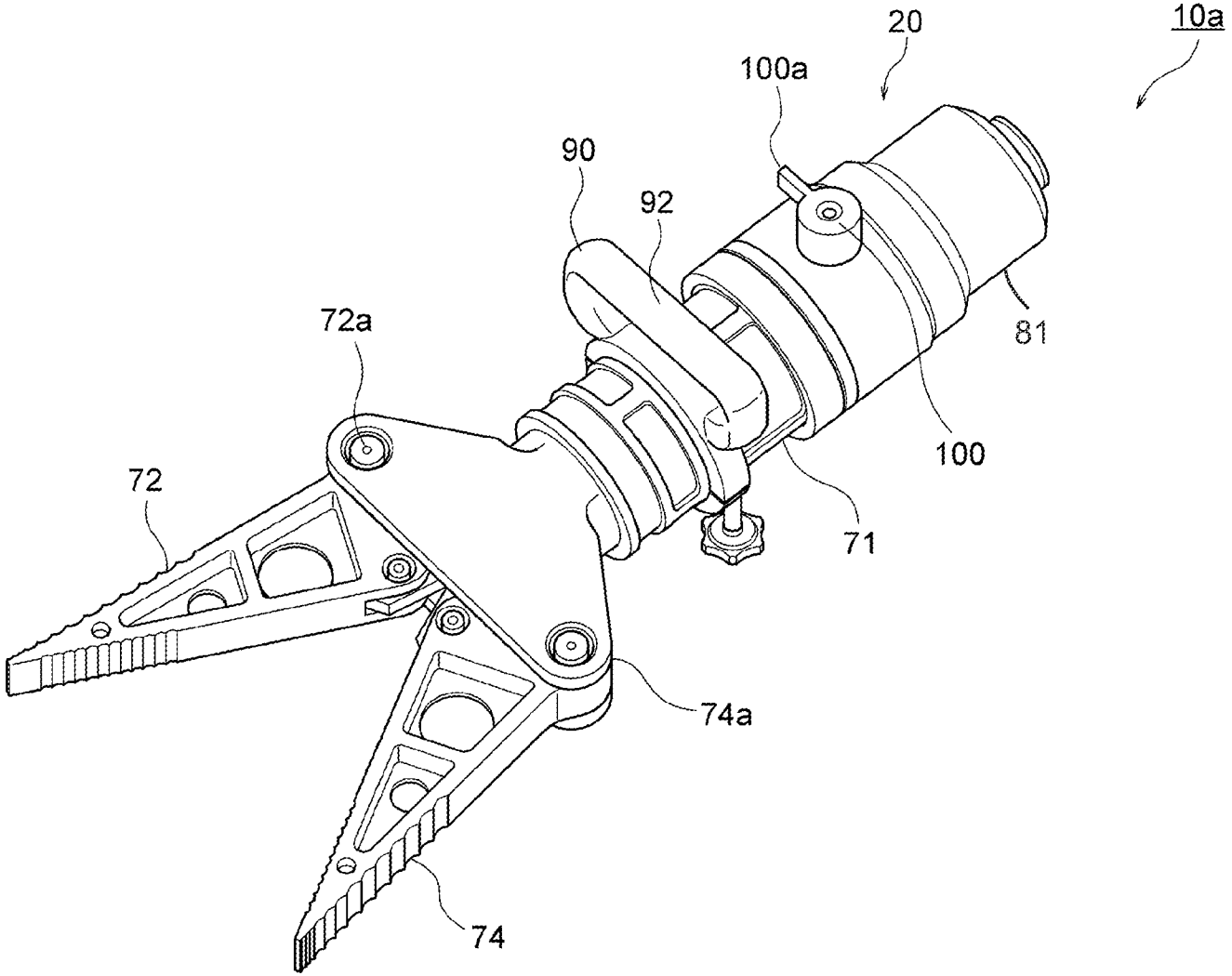
Prior Art FIG. 13
FIG. 13 is a perspective view illustrating the structure of a conventional hydraulic device.
Figure 14:
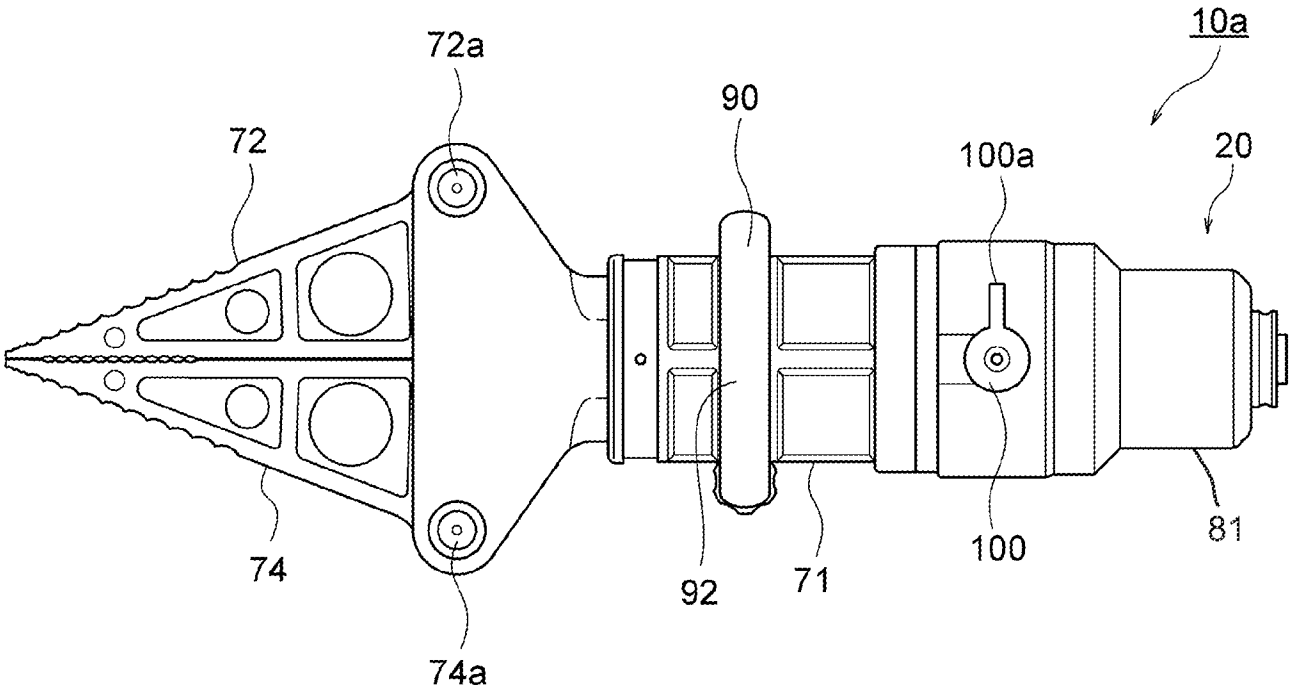
Prior Art FIG. 14
FIG. 14 is a top view of the hydraulic device shown in FIG. 13.
Figure 15:
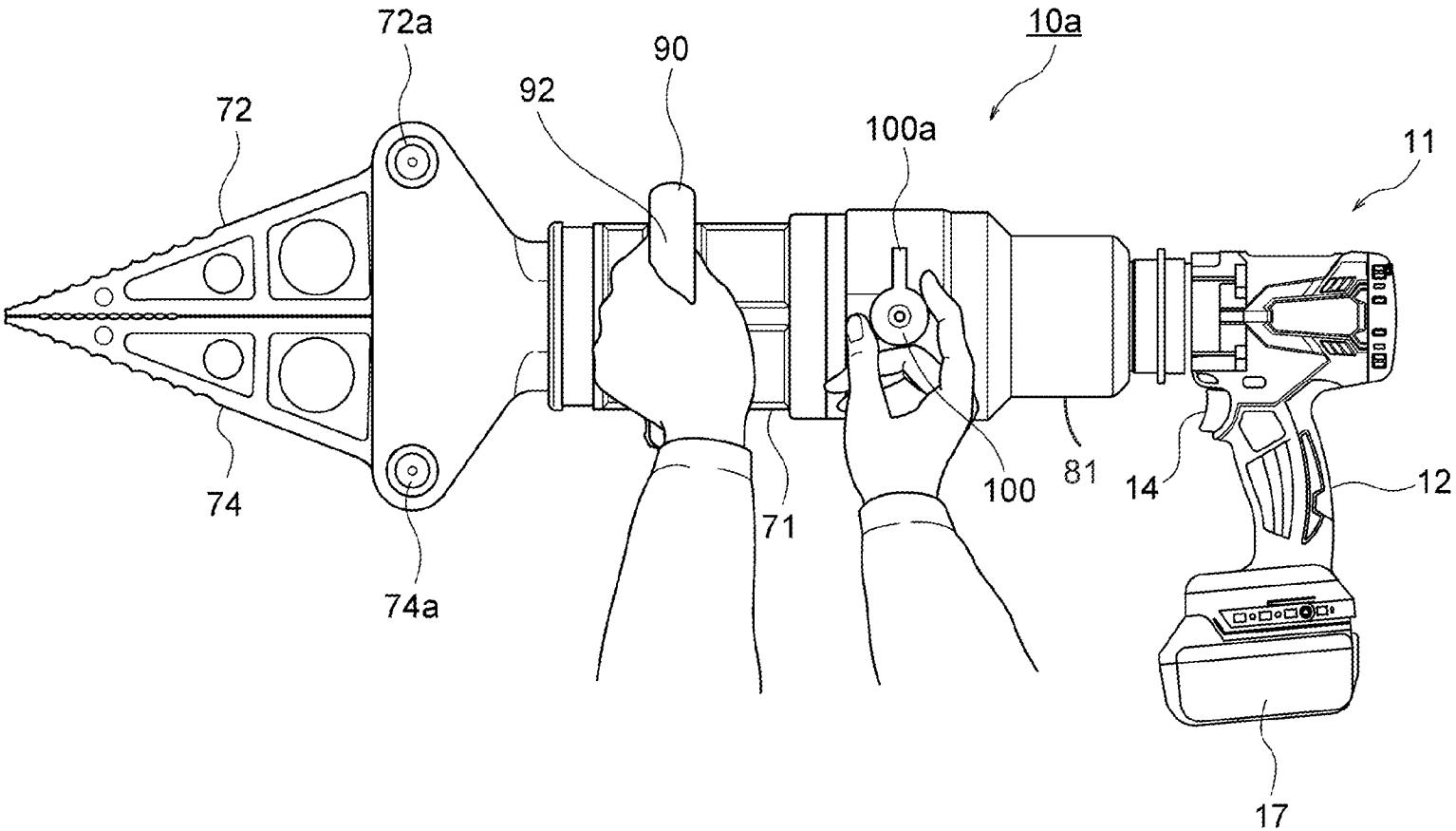
Prior Art FIG. 15
FIG. 15 illustrates a state where, with the conventional hydraulic device shown in FIGS. 13 and 14, the worker operates an actuation knob with the right hand while grasping a handle with the left hand.

To further clarify the advantageous effects of the hydraulic device 10 of the present embodiment described above, a conventional hydraulic device 10*a* will be described below. FIG. 13 is a perspective view illustrating the structure of the conventional hydraulic device 10*a*, FIG. 14 is a top view of the hydraulic device 10*a* shown in FIG. 13, and FIG. 15 illustrates a state where, with the conventional hydraulic device 10*a* shown in FIGS. 13 and 14, the worker operates an actuation knob 100 with the right hand while grasping the handle 90 with the left hand. In the description of the conventional hydraulic device 10*a*, components that are the same as those of the hydraulic device 10 of the present embodiment are designated by the same reference characters, and the description thereof is omitted.

In the conventional hydraulic device 10*a*, the actuation knob 100 having a substantially disc shape is used, instead of a lever, as an operation part for operating the switching part 88. When the actuation knob 100 is rotated by the worker, the switching part 88 advances and retracts in a direction orthogonal to the direction in which the actuation knob 100 is rotated (that is, to the direction along the sheet of FIG. 14). More specifically, a projection portion 100*a* which is held by fingers of the worker is formed on the actuation knob 100, and the worker can rotate the actuation knob 100 by holding the projection portion 100*a* with the fingers. When the actuation knob 100 is located at a later-described neutral position, the projection portion 100*a* faces right upward as shown in FIG. 14. When the worker rotates the actuation knob 100 from such a position such that the projection portion 100*a* is tilted in any of the leftward and rightward directions in FIG. 14, the actuation knob 100 is located at an advance position or a retraction position. In addition, the angle by which the actuation knob 100 is rotatable is limited, for example, within a range of 60°.

In the conventional hydraulic device 10*a* shown in FIGS. 13 and 14, the actuation knob 100 is away from the handle 90. Thus, as shown in FIG. 15, while the worker is holding the grip portion 12 of the drive unit 11 with one hand (for example, the right hand) and is grasping the handle 90 with the other hand (for example, the left hand), when the worker operates the actuation knob 100, the worker has to release the right hand from the grip portion 12 and operate the actuation knob 100 with the right hand. Thus, there is a problem that the workability deteriorates. On the other hand, in the hydraulic device 10 of the present embodiment, the operation part 80 for operating the switching part 88 is disposed at a position that allows the operation part 80 to be operated with the hand of the worker holding the handle 90, or with the finger of the hand holding the handle 90. Thus, when performing work with the tip tool 70 by holding the grip portion 12 close to the electric motor with one hand (for example, the right hand) and grasping the handle 90 with the other hand (for example, the left hand), the worker can operate the operation part 80 with the hand of the worker holding the handle 90, or with the finger of the hand holding the handle 90, without releasing any hand from the handle 90 or the grip portion 12, and thus the workability can be improved.

Moreover, in the hydraulic device 10 of the present embodiment, as described above, the operation part 80 has the shaft part 82*a*, the lever 82 which is attached to the shaft part 82*a* and which rotates about the axis of the shaft part 82*a*, and the operation portion 86 which is disposed at the lever 82 and which is operated with the finger of the worker holding the handle 90 with the hand. The path in the oil passages 30, 32, 50, and 52 is switched at the switching part 88 by rotation of the shaft part 82*a* of the operation part 80.

As described above, the lever 82 is movable between the neutral position, the advance position, and the retraction position. When the lever 82 is located at the neutral position, the path in the oil passages 30, 32, 50, and 52 is closed at the switching part 88, whereby the tip tool 70 does not operate. When the lever 82 is located at the advance position, the path in the oil passages 30, 32, 50, and 52 is switched at the switching part 88 such that the tip tool 70 moves in a first direction (specifically, a direction in which the prying members 72 and 74 are opened). When the lever 82 is located at the retraction position, the path in the oil passages 30, 32, 50, and 52 is switched at the switching part 88 such that the tip tool 70 moves in a second direction (specifically, a direction in which the prying members 72 and 74 are closed).

As described above, the operation portion 86, which is disposed at the lever 82 of the operation part 80, is formed by cutting the portion 86*b* from the substantially spherical body. Thus, even when the lever 82 is located at any position, the lever 82 can be easily operated with the hand of the worker holding the handle 90, or with the finger of the hand holding the handle 90, and the distance from the handle 90 to the operation portion 86 can be decreased. If the worker has small hands, even when the lever 82 is located at any position, the thumb of the hand grasping the handle 90 can be put in the recess 86*a* as shown in FIG. 2. Thus, the lever 82 can be easily operated. In addition, if the worker has big hands, the worker can operate the lever 82 by hooking the thumb of the hand grasping the handle 90, on the outer portion of the operation portion 86 as shown in FIG. 10. Moreover, if the worker has bigger hands, the worker may operate the center portion of the lever 82 with the palm or the like of the hand grasping the handle 90, not with the finger of the hand. The operability improves when the operation portion 86 is as close to the handle 90 as possible, but the hand grasping the handle 90 may interfere with the operation portion 86 if the operation portion 86 is excessively close to the handle 90. On the other hand, when the operation portion 86 is formed by cutting the portion 86*b* from the substantially spherical body, the hand grasping the handle 90 can be inhibited from interfering with the operation portion 86, and thus the operation portion 86 can be as close to the handle 90 as possible, so that the operability improves. Furthermore, since the recess 86*a* is formed on the operation portion 86, the thumb or the like can be inserted and hooked on the recess 86*a*. Thus, even a person who has small hands or short fingers can easily rotate the lever 82.

When the lever 82 is located at the neutral position, the lever 82 extends from the shaft part 82*a* toward the handle 90. In addition, the advance position and the retraction position of the lever 82 are located at the opposite sides with the neutral position interposed therebetween.

The hydraulic device according to the present embodiment is not limited to the above-described aspect, and various modifications can be made.

For example, in the above-described hydraulic device 10, the switching part 88 switches the paths for both the pressure oil and the return oil in the oil passage, but the present embodiment is not limited to such an aspect. In another aspect, the switching part 88 may switch only the path for any one of the pressure oil and the return oil in the oil passage.

In the above-described hydraulic device 10, when the switching part 88 moves in the up-down direction in FIGS. 8 and 9 along the axial direction, the position of each groove formed on the outer circumferential surface of the switching part 88 changes, and the grooves in the hole 40 that have been closed by the switching part 88 become opened, or the grooves in the hole 40 become closed by the switching part 88, whereby the paths for the pressure oil and the return oil in the oil passage are switched. However, the present embodiment is not limited to such an aspect. In another aspect, no groove may be formed on the outer circumferential surface of the switching part 88, and, when the switching part 88 moves in the up-down direction in FIGS. 8 and 9 along the axial direction, the grooves in the hole 40 that have been closed by the switching part 88 may become opened, or the grooves in the hole 40 may become closed by the switching part 88, whereby the paths for the pressure oil and the return oil in the oil passage may be switched. In still another aspect, no groove may be formed on the peripheral wall of the hole 40, and, when the switching part 88 moves in the up-down direction in FIGS. 8 and 9 along the axial direction, the position of each groove formed on the outer circumferential surface of the switching part 88 may change, whereby the paths for the pressure oil and the return oil in the oil passage may be switched.

In the hydraulic device 10 of the present embodiment, the motor 16 is disposed as a drive part for driving the hydraulic pump 20, but the operation part 80 may operate the switching part 88 and also switch ON/OFF of the motor 16. Specifically, when the lever 82 of the operation part 80 is located at the neutral position, the motor 16 may not be driven, and when the lever 82 of the operation part 80 is located at the advance position or the retraction position, the motor 16 may be driven. In still another example, the operation part 80 may not operate the switching part 88 and may switch only ON/OFF of the motor 16.

Figure 16:
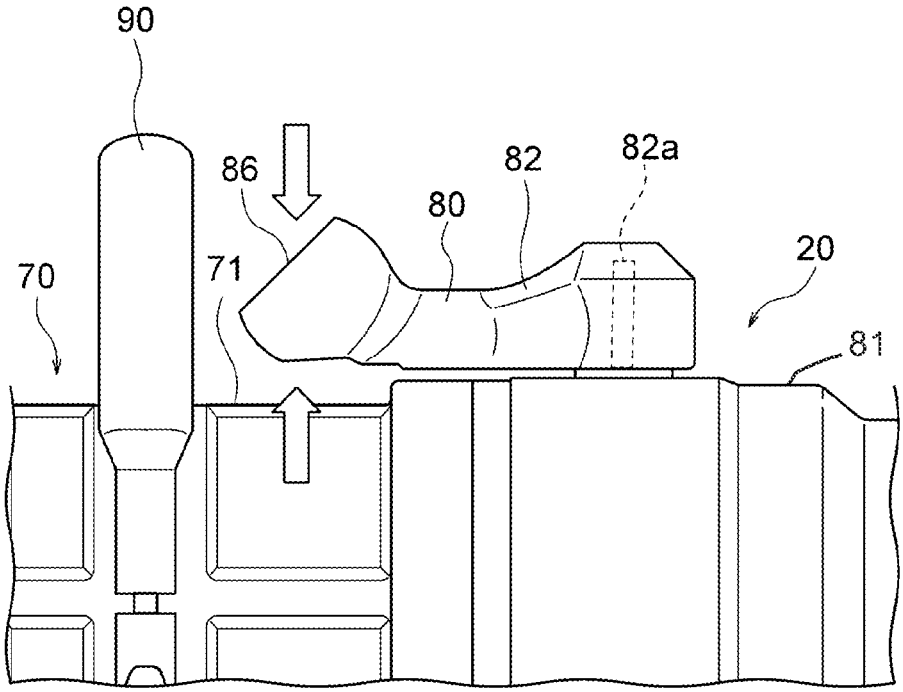
FIG. 16 is a side view illustrating movement of an operation part according to a modification.

In the hydraulic device 10 shown in FIGS. 1 to 10, the lever 82 is rotatable about the axis of the shaft part 82*a*, but the present embodiment is not limited to such an aspect. A hydraulic device according to a modification will be described with reference to FIG. 16. In the example shown in FIG. 16, the lever 82 of the operation part 80 is movable in a direction toward the main body 81 (that is, downward in FIG. 16) and in a direction away from the main body 81 (that is, upward in FIG. 16). When the lever 82 of the operation part 80 is moved in the direction toward the main body 81 or in the direction away from the main body 81, the paths in the oil passages 30, 32, 50, and 52 are switched at the switching part 88.

As the lever of the operation part, a member that is not provided with a recess but provided with a simple spherical operation portion at an end thereof may be used. In addition, a simple bar-like member may be used as the lever of the operation part. As described above, the operation part can have any structure or shape.

In the hydraulic device 10 shown in FIGS. 1 to 10, the tip tool 70 having the pair of prying members 72 and 74 for widening a gap of an object is used as the tip tool, but another kind of tip tool may be attached to the main body 81 portion of the hydraulic device.

Figure 17:
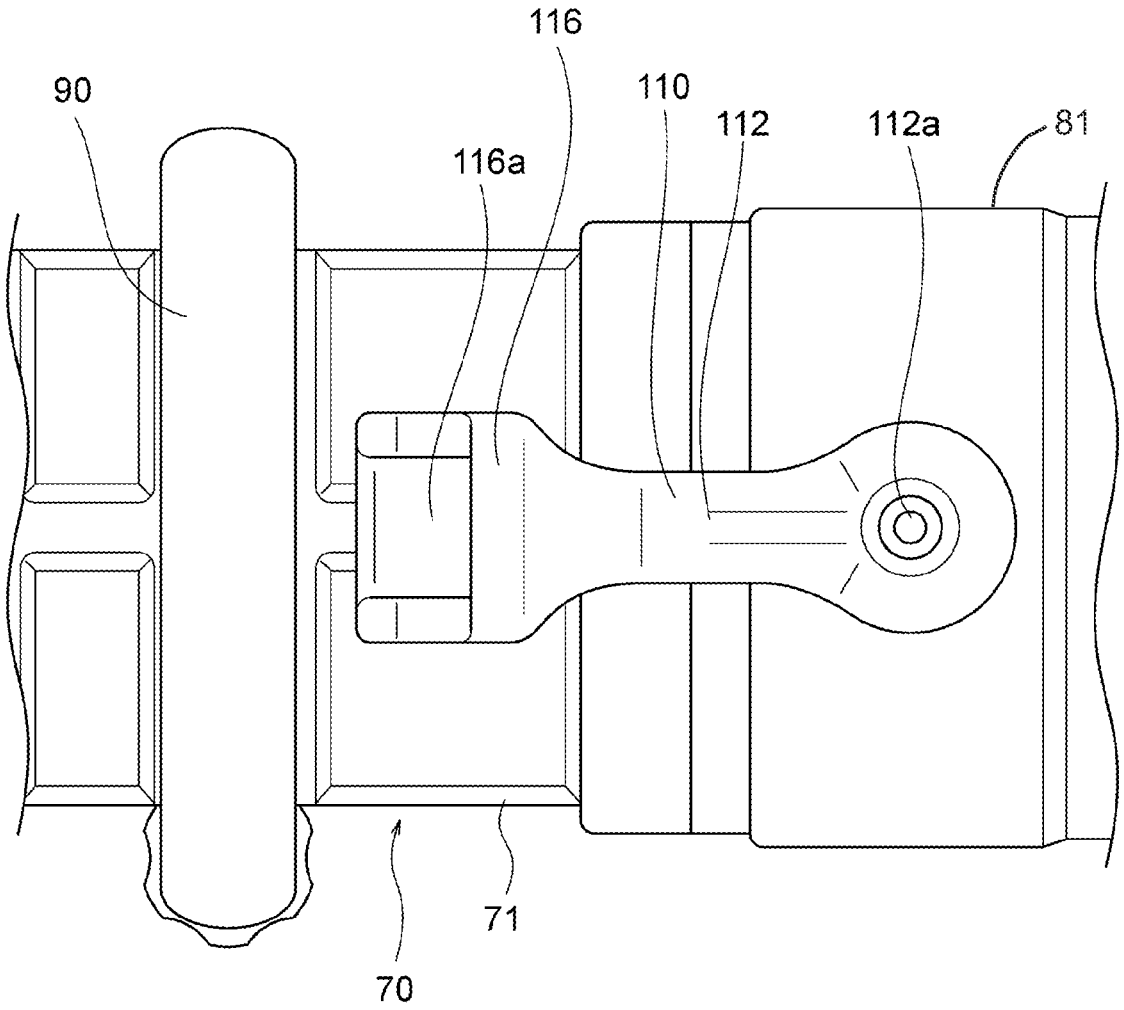
FIG. 17 is a top view illustrating the structure of an operation part according to another modification.
Figure 18:
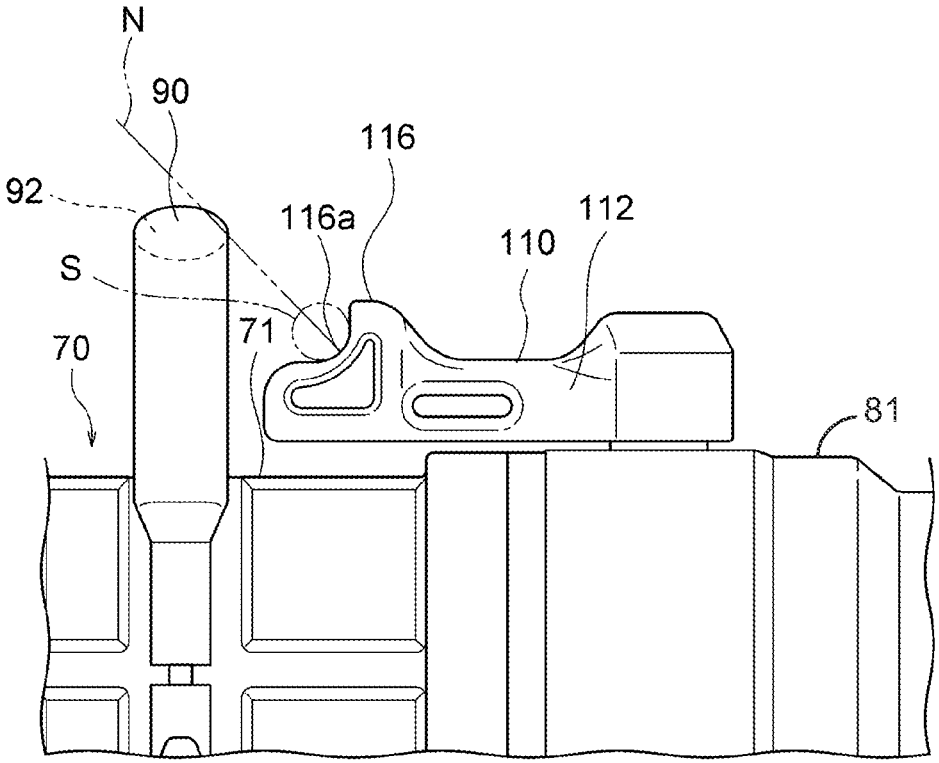
FIG. 18 is a side view of the operation part shown in FIG. 17.
Figure 19:
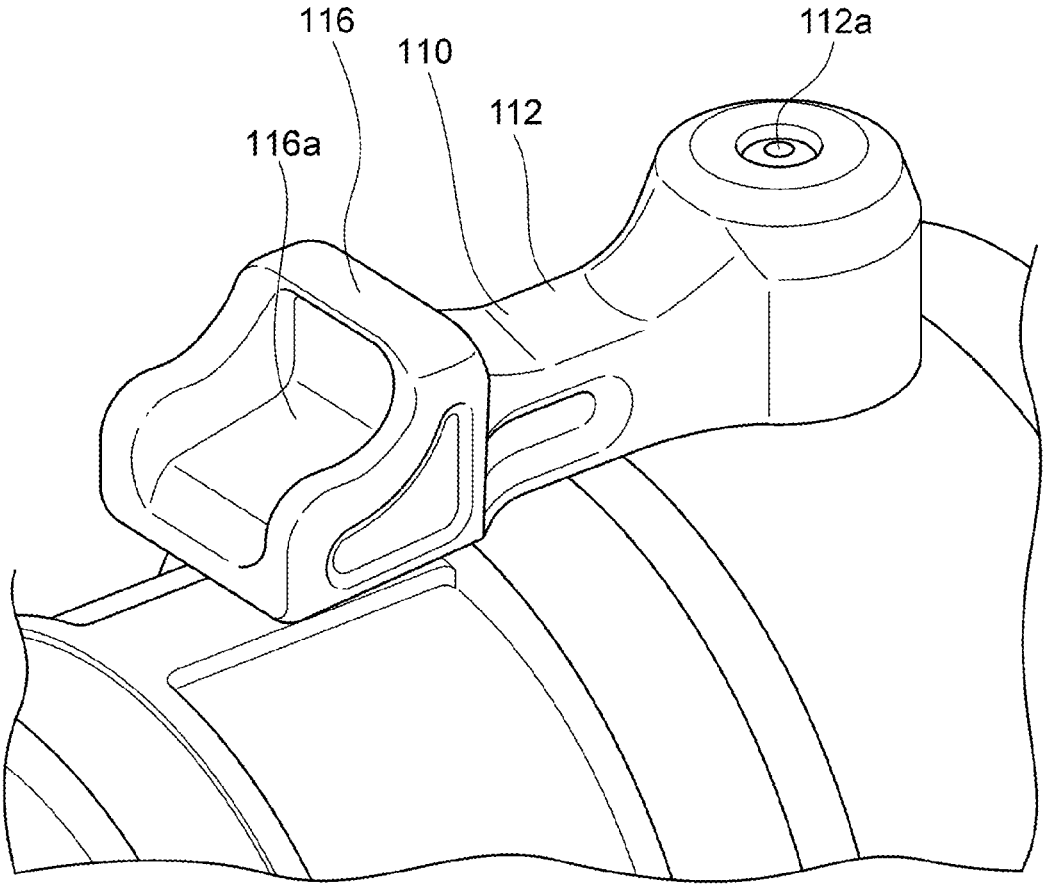
FIG. 19 is a perspective view of the operation part shown in FIGS. 17 and 18.

As the operation part, an operation part shown in FIGS. 17 to 19 may be used. FIG. 17 is a top view illustrating the structure of an operation part 110 according to another modification, FIG. 18 is a side view of the operation part 110 shown in FIG. 17, and FIG. 19 is a perspective view of the operation part 110 shown in FIGS. 17 and 18. In the description of the operation part 110 shown in FIGS. 17 to 19, components that are the same as those of the hydraulic device 10 shown in FIGS. 1 to 10 are designated by the same reference characters, and the description thereof is omitted.

As shown in FIGS. 17 to 19, the operation part 110 has a lever 112 which is operated by the worker, and a substantially cylindrical lever attachment part (not shown) to which the lever 112 is attached. More specifically, a shaft part 112*a* is disposed at the lever 112, and is connected to the lever attachment part. The lever 112 is rotatable integrally with the lever attachment part about the shaft part 112*a*. In addition, the rotation angle of the lever 112 and the lever attachment part is limited within a predetermined range (for example, within a range of 60°).

Although the lever 112 is rotatable within a predetermined range about the axis of the shaft part 112*a*, the position of the operation part 110 shown in FIG. 17 is defined as a neutral position, the position at which the lever 112 cannot be further rotated when the lever 112 rotates clockwise about the axis of the shaft part 112*a* from the position shown in FIG. 17 is defined as an advance position, and the position at which the lever 112 cannot be further rotated when the lever 112 rotates counterclockwise about the axis of the shaft part 112*a* from the position shown in FIG. 17 is defined as a retraction position. As described above, in the example shown in FIGS. 17 to 19 as well, the operation part 110 can be moved between the neutral position, the advance position, and the retraction position. In addition, when the lever 112 is located at the neutral position, the lever 112 extends from the shaft part 112*a* toward the handle 90, and the advance position and the retraction position of the lever 112 are located at the opposite sides with the neutral position interposed therebetween. In another structure example of the lever 112, the position of the operation part 110 shown in FIG. 17 may be defined as the neutral position, the position at which the lever 112 cannot be further rotated when the lever 112 rotates clockwise about the axis of the shaft part 112*a* from the position shown in FIG. 17 may be defined as the retraction position, and the position at which the lever 112 cannot be further rotated when the lever 112 rotates counterclockwise about the axis of the shaft part 112*a* from the position shown in FIG. 17 may be defined as the advance position. In still another structure example, a hydraulic device, in which the lever 112 is movable only between the advance position and the retraction position and there is no neutral position, may be used.

The lever 112 of the operation part 110 is provided with an operation portion 116 which is operated, with the hand of the worker holding the handle 90, or with the finger of the hand holding the handle 90. In addition, the operation portion 116 has a curved recess 116*a*, and, for example, the thumb of the worker grasping the handle 90 with the hand is put in the recess 116*a*. Accordingly, the worker grasping the handle 90 with the hand is allowed to rotate the lever 112 between the neutral position, the advance position, and the retraction position by putting the thumb in the recess 116*a* without releasing the hand from the handle 90. Moreover, as shown in FIG. 18, the recess 116*a* has a shape curved such that the recess 116*a* is a part of the spherical surface of a virtual sphere indicated by reference character S. When the recess 116*a* is a part of the spherical surface of the virtual sphere S, a line (indicated by reference character N in FIG. 18) connecting the center of the recess 116*a* to the center of the virtual sphere S is tilted relative to the longitudinal direction of the hydraulic device (that is, the right-left direction in FIG. 18). In addition, the line N connecting the center of the recess 116*a* to the center of the virtual sphere S extends from the recess 116*a* toward the bar-like portion 92 of the handle 90. Owing to the recess 116*a* having such a shape, the thumb of the hand grasping the handle 90 is easily put in the recess 116*a*, and thus the operability of the operation part 110 can be improved.

Similar to the operation part 80 shown in FIGS. 1 to 10, in the operation part 110 shown in FIGS. 17 to 19, even when the lever 112 is located at any position, the operation portion 116 is located within the range of a region obtained by cutting a virtual sphere that has a predetermined size (for example, 75 mm) and that is centered at the side edge, closer to the operation part 110, of the bar-like portion 92 of the handle 90, into ¼. In addition, when the lever 112 is located at the center position, the recess 116*a* of the operation portion 116 is located within the range of a region obtained by cutting a virtual sphere that has another predetermined size (for example, 50 mm) and that is centered at the side edge, closer to the operation part 110, of the bar-like portion 92 of the handle 90, into ¼. In this case as well, the thumb of the hand grasping the handle 90 is easily put in the recess 116*a*, and thus the operability of the operation part 110 can be improved.

Even in the case where the operation part 110 shown in FIGS. 17 to 19 is used, similar to the case where the operation part 80 shown in FIGS. 1 to 10 is used, when performing work with the tip tool 70 by holding the grip portion 12 close to the electric motor with one hand and grasping the handle 90 with the other hand, the worker can operate the operation part 110 with the hand of the worker holding the handle 90, or with the finger of the hand holding the handle 90, without releasing the hand from the handle 90, and thus the workability can be improved.

Figure 20:
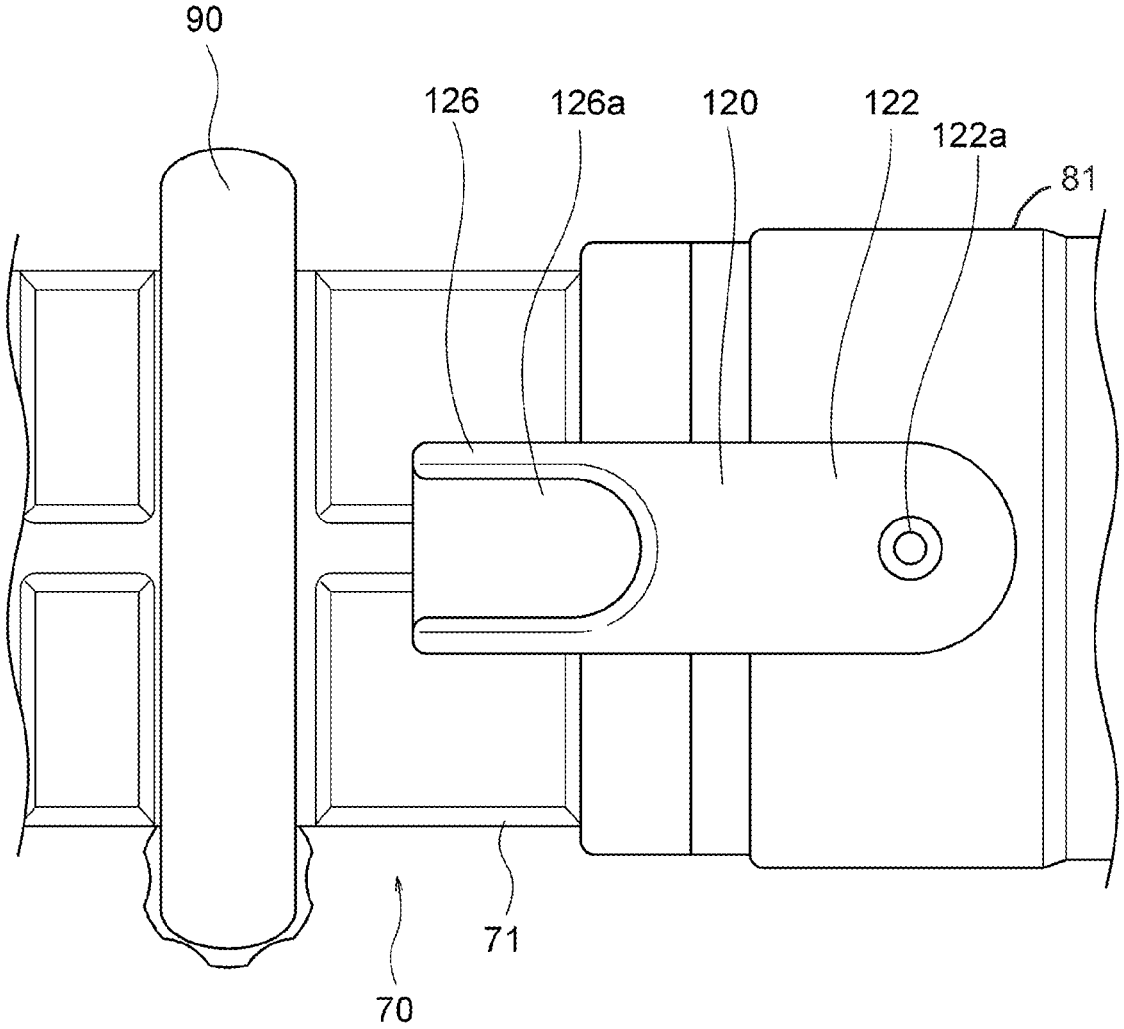
FIG. 20 is a top view illustrating the structure of an operation part according to still another modification.
Figure 21:
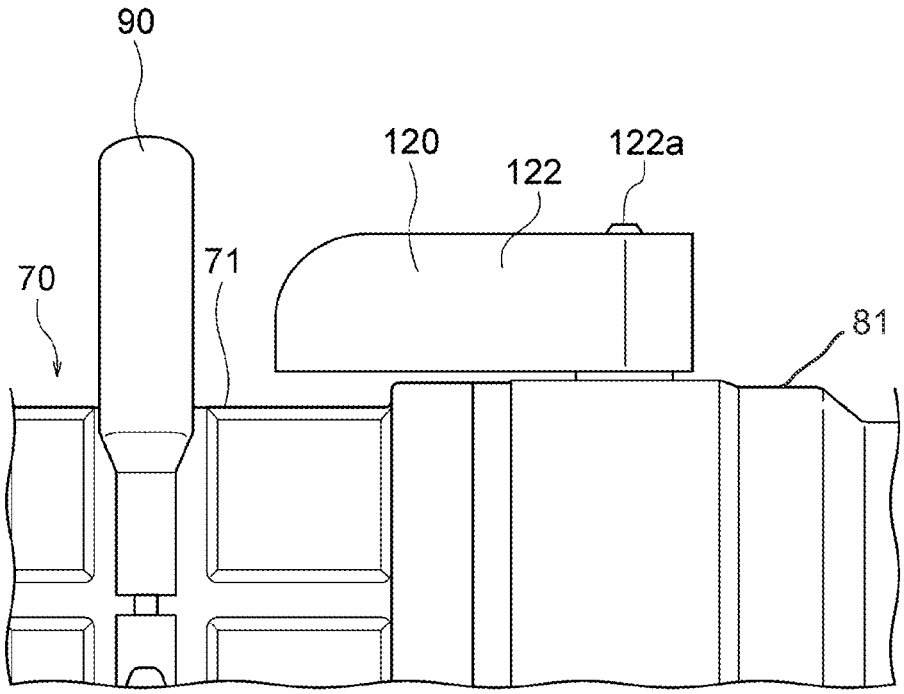
FIG. 21 is a side view of the operation part shown in FIG. 20.
Figure 22:
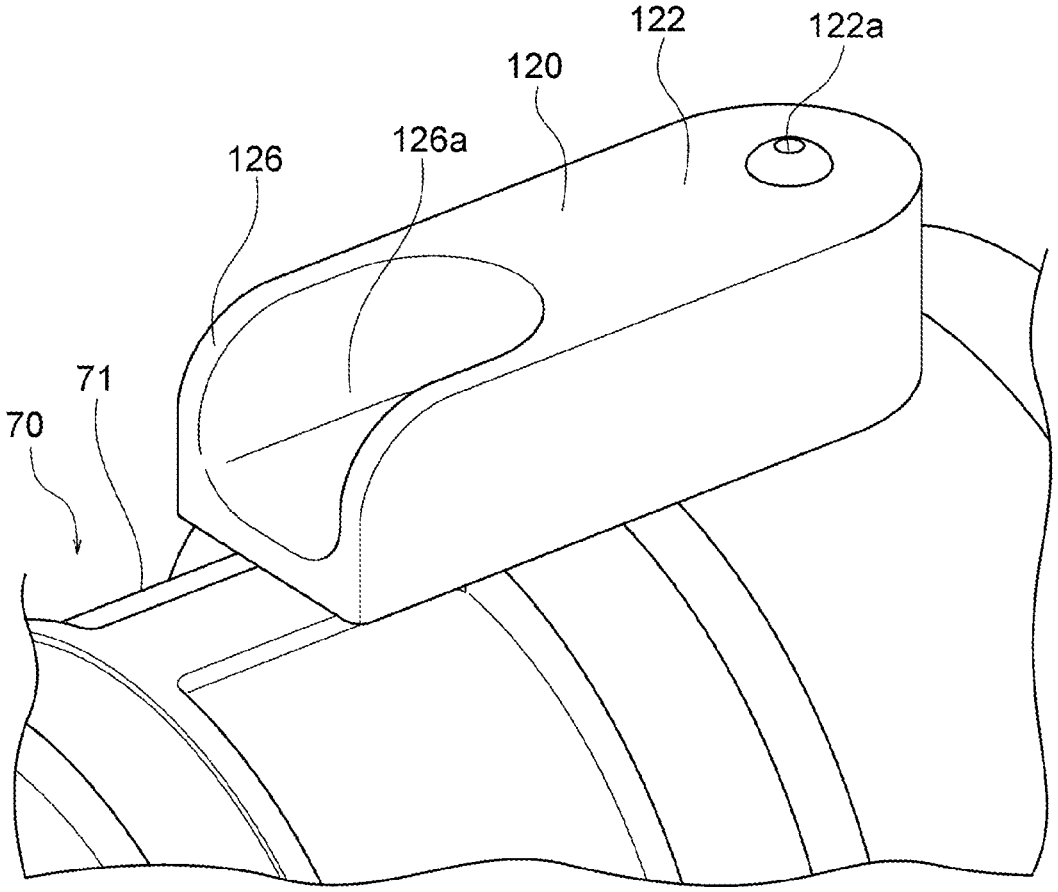
FIG. 22 is a perspective view of the operation part shown in FIGS. 20 and 21.

As the operation part, an operation part shown in FIGS. 20 to 22 may be used. FIG. 20 is a top view illustrating the structure of an operation part 120 according to still another modification, FIG. 21 is a side view of the operation part 120 shown in FIG. 20, and FIG. 22 is a perspective view of the operation part 120 shown in FIGS. 20 and 21. In the description of the operation part 120 shown in FIGS. 20 to 22, components that are the same as those of the hydraulic device 10 shown in FIGS. 1 to 10 are designated by the same reference characters, and the description thereof is omitted.

As shown in FIGS. 20 to 22, the operation part 120 has a lever 122 which is operated by the worker, and a substantially cylindrical lever attachment part (not shown) to which the lever 122 is attached. More specifically, a shaft part 122*a* is disposed at the lever 122, and is connected to the lever attachment part. The lever 122 is rotatable integrally with the lever attachment part about the shaft part 122*a*. In addition, the rotation angle of the lever 122 and the lever attachment part is limited within a predetermined range (for example, within a range of 60°).

Although the lever 122 is rotatable within a predetermined range about the axis of the shaft part 122*a*, the position of the operation part 120 shown in FIG. 20 is defined as a neutral position, the position at which the lever 122 cannot be further rotated when the lever 122 rotates clockwise about the axis of the shaft part 122*a* from the position shown in FIG. 20 is defined as an advance position, and the position at which the lever 122 cannot be further rotated when the lever 122 rotates counterclockwise about the axis of the shaft part 122*a* from the position shown in FIG. 20 is defined as a retraction position. As described above, in the example shown in FIGS. 20 to 22 as well, the operation part 120 can be moved between the neutral position, the advance position, and the retraction position. In addition, when the lever 122 is located at the neutral position, the lever 122 extends from the shaft part 122*a* toward the handle 90, and the advance position and the retraction position of the lever 122 are located at the opposite sides with the neutral position interposed therebetween. In another structure example of the lever 122, the position of the operation part 120 shown in FIG. 20 may be defined as the neutral position, the position at which the lever 122 cannot be further rotated when the lever 122 rotates clockwise about the axis of the shaft part 122*a* from the position shown in FIG. 20 may be defined as the retraction position, and the position at which the lever 122 cannot be further rotated when the lever 122 rotates counterclockwise about the axis of the shaft part 122*a* from the position shown in FIG. 20 may be defined as the advance position. In still another structure example, a hydraulic device, in which the lever 122 is movable only between the advance position and the retraction position and there is no neutral position, may be used.

The lever 122 of the operation part 120 is provided with an operation portion 126 which is operated with the hand of the worker holding the handle 90, or with the finger of the hand holding the handle 90. In addition, the operation portion 126 has a curved recess 126*a*, and, for example, the thumb of the worker grasping the handle 90 with the hand is put in the recess 126*a*. Accordingly, the worker grasping the handle 90 with the hand is allowed to rotate the lever 122 between the neutral position, the advance position, and the retraction position by putting the thumb in the recess 126*a* without releasing the hand from the handle 90.

Even in the case where the operation part 120 shown in FIGS. 20 to 22 is used, similar to the case where the operation part 80 shown in FIGS. 1 to 10 is used, when performing work with the tip tool 70 by holding the grip portion 12 close to the electric motor with one hand and grasping the handle 90 with the other hand, the worker can operate the operation part 120 with the hand of the worker holding the handle 90, or with the finger of the hand holding the handle 90, without releasing the hand from the handle 90, and thus the workability can be improved.

What is claimed is:

1. A hydraulic device comprising:

a hydraulic pump configured to generate pressure oil;

a tool configured to operate by the pressure oil generated by the hydraulic pump;

an oil passage for sending the pressure oil generated by the hydraulic pump to the tool and returning return oil from the tool to the hydraulic pump;

a handle configured to be held by one hand of a worker;

a switching part disposed at the oil passage and configured to switch a path for at least one of the pressure oil and the return oil; and an operation part for operating the switching part, wherein the operation part is disposed at a position that allows the operation part to be operated with the hand of the worker holding the handle, or with a finger of the hand holding the handle, the operation part has a shaft part, a lever which is attached to the shaft part and which is configured to rotate about an axis of the shaft part, and an operation portion which is disposed at the lever and which is configured to be operated with the hand of the worker holding the handle, or with the finger of the hand holding the handle, the path in the oil passage is switched at the switching part by rotation of the shaft part of the operation part, the lever is movable between an advance position and a retraction position, when the lever is located at the advance position, the path in the oil passage is switched at the switching part such that the tool moves in a first direction, and when the lever is located at the retraction position, the path in the oil passage is switched at the switching part such that the tool moves in a second direction.

2. The hydraulic device according to claim 1, wherein a distance between the handle and the operation part in a longitudinal direction of the hydraulic device falls within a range of 0 mm to 50 mm.

3. The hydraulic device according to claim 2, wherein the distance between the handle and the operation part in the longitudinal direction of the hydraulic device falls within a range of 5 mm to 50 mm.

4. The hydraulic device according to claim 3, wherein the distance between the handle and the operation part in the longitudinal direction of the hydraulic device falls within a range of 9 mm to 45 mm.

5. The hydraulic device according to claim 1, wherein the handle has a bar-like portion extending in a direction orthogonal to a longitudinal direction of the hydraulic device, and the worker is allowed to operate the operation part with the hand grasping the bar-like portion of the handle, or with the finger of the hand grasping the bar-like portion of the handle.

6. The hydraulic device according to claim 5, wherein a distance from a main body of the hydraulic device to the bar-like portion of the handle is larger than a distance from the main body of the hydraulic device to the operation part.

7. The hydraulic device according to claim 1, wherein the operation portion is formed by cutting a portion from a substantially spherical body.

8. The hydraulic device according to claim 7, wherein a line which passes through a center of a flat surface, of the operation portion, obtained by cutting the portion from the substantially spherical body and which is orthogonal to the flat surface is tilted relative to a longitudinal direction of the hydraulic device.

9. The hydraulic device according to claim 8, wherein the handle has a bar-like portion extending in a direction orthogonal to the longitudinal direction of the hydraulic device, and the worker is allowed to operate the operation part with the hand grasping the bar-like portion of the handle, or with the finger of the hand grasping the bar-like portion of the handle, and the line which passes through the center of the flat surface, of the operation portion, obtained by cutting the portion from the substantially spherical body and which is orthogonal to the flat surface extends toward the bar-like portion of the handle.

10. The hydraulic device according to claim 7, wherein a recess is formed on the operation portion at a location where the portion is cut from the substantially spherical body, and the recess has a shape curved such that the recess is a part of a spherical surface of a virtual sphere.

11. The hydraulic device according to claim 10, wherein a line connecting a center of the recess to a center of the virtual sphere is tilted relative to a longitudinal direction of the hydraulic device.

12. The hydraulic device according to claim 10, wherein the handle has a bar-like portion extending in a direction orthogonal to the longitudinal direction of the hydraulic device, and the worker is allowed to operate the operation part with the hand grasping the bar-like portion of the handle, or with the finger of the hand grasping the bar-like portion of the handle, and a line connecting a center of the recess to a center of the virtual sphere extends toward the bar-like portion of the handle.

13. The hydraulic device according to claim 1, wherein the lever is also movable to a neutral position, and when the lever is located at the neutral position, the path in the oil passage is closed at the switching part, whereby the tool does not operate.

14. The hydraulic device according to claim 13, wherein the lever extends from the shaft part toward the handle when the lever is located at the neutral position.

15. The hydraulic device according to claim 13, wherein the advance position and the retraction position of the lever are located at opposite sides with the neutral position interposed therebetween.

16. The hydraulic device according to claim 1, further comprising a drive part configured to drive the hydraulic pump, wherein the operation part is configured to be able to switch ON/OFF of the drive part.

17. The hydraulic device according to claim 1, wherein the operation part is moveable in a direction toward a main body and in a direction away from the main body, and when the operation part is moved in the direction toward the main body or in the direction away from the main body, the path in the oil passage is switched at the switching part.

18. The hydraulic device according to claim 17, wherein the operation part has a lever and an operation portion which is disposed at the lever and which is configured to be operated with the hand of the worker holding the handle, or with the finger of the hand holding the handle, the operation portion is formed by cutting a portion from a substantially spherical body, and when the lever or the operation portion of the operation part is moved in the direction toward the main body or in the direction away from the main body, the path in the oil passage is switched at the switching part.

* * * * *